US009581071B2

(12) United States Patent
Kim et al.

(10) Patent No.: US 9,581,071 B2
(45) Date of Patent: Feb. 28, 2017

(54) COOLING SYSTEM FOR INDUSTRIAL VEHICLE

(71) Applicant: NACCO Materials Handling Group, Inc., Fairview, OR (US)

(72) Inventors: Hoon Kim, Portland, OR (US); Anya Getman, Sandy, OR (US)

(73) Assignee: HYSTER-YALE GROUP, INC., Fairview, OR (US)

( * ) Notice: Subject to any disclaimer, the term of this patent is extended or adjusted under 35 U.S.C. 154(b) by 150 days.

(21) Appl. No.: 14/497,211

(22) Filed: Sep. 25, 2014

(65) Prior Publication Data

US 2016/0090892 A1 Mar. 31, 2016

(51) Int. Cl.

| | |
|---|---|
| ***F01P 7/04*** | (2006.01) |
| ***F01P 9/00*** | (2006.01) |
| ***F01P 1/06*** | (2006.01) |
| *F01P 1/00* | (2006.01) |

(52) U.S. Cl.

CPC ..... *F01P 1/06* (2013.01); *F01P 2001/005* (2013.01); *F01P 2060/16* (2013.01)

(58) Field of Classification Search

CPC ..... B60K 11/085; B60K 11/04; B60K 11/06; B60K 11/00; B60K 11/02; B60K 11/08; B60K 5/00; F01P 3/18; F01P 11/10; F01P 5/06; F01P 3/12; F01P 1/06; B60H 2001/3277; F02B 29/0412; F02B 29/0431

See application file for complete search history.

(56) References Cited

U.S. PATENT DOCUMENTS

| | | | | |
|---|---|---|---|---|
| 4,862,981 | A * | 9/1989 | Fujikawa | B60K 5/10 180/68.4 |
| 5,477,687 | A * | 12/1995 | Horn | B60H 1/32 62/323.4 |
| 6,192,838 | B1 * | 2/2001 | Matsuo | B60K 11/08 123/41.01 |
| 7,228,823 | B2 | 6/2007 | Lee | |
| 8,020,655 | B2 * | 9/2011 | Robinson | B60K 11/04 180/68.1 |
| 2002/0104491 | A1 * | 8/2002 | Izumi | E02F 9/00 123/41.49 |
| 2005/0178132 | A1 * | 8/2005 | Sakaguchi | B60H 1/3205 62/181 |
| 2006/0048986 | A1 * | 3/2006 | Bracciano | B60H 1/28 180/69.2 |
| 2008/0032572 | A1 * | 2/2008 | Burgoyne | B60F 3/0053 440/88 C |

(Continued)

*Primary Examiner* — Marguerite McMahon
*Assistant Examiner* — Tea Holbrook
(74) *Attorney, Agent, or Firm* — Schwabe Williamson & Wyatt

(57) ABSTRACT

A cooling system for an industrial vehicle includes one or more heat radiation devices located in a containment. The one or more heat radiation devices may be configured to cool a plurality of components in the industrial vehicle. An air intake device may be configured to create airflow from outside of the industrial vehicle into the containment. The airflow passes through the one or more heat radiation devices. The cooling system may further include a control device operatively connected to the containment. The control device may be configured to selectively direct at least a portion of the airflow to the plurality of components in the industrial vehicle after the airflow passes through the one or more heat radiation devices.

24 Claims, 13 Drawing Sheets

(56) References Cited

U.S. PATENT DOCUMENTS

| | | | | |
|---|---|---|---|---|
| 2008/0283215 | A1* | 11/2008 | Saida | B60H 1/00828 165/43 |
| 2011/0147104 | A1* | 6/2011 | Ogawa | B60K 1/04 180/65.22 |
| 2011/0297468 | A1* | 12/2011 | Coel | B60K 11/085 180/68.1 |
| 2012/0085510 | A1* | 4/2012 | Kim | B60K 11/02 165/44 |
| 2013/0247847 | A1* | 9/2013 | Nogawa | F01P 3/02 123/41.34 |
| 2013/0305717 | A1* | 11/2013 | Roehr | E02D 3/026 60/605.2 |
| 2015/0151628 | A1* | 6/2015 | Sakai | E02F 3/764 180/68.1 |

* cited by examiner

1400

| | Vehicle Mode of Operation | | | |
|---|---|---|---|---|
| | Start-Up/cold ambient condition | Light-Duty | Med-Duty | Heavy-Duty |
| Priority | | | | |
| Engine Head | X | 1 | 1 | 1 |
| Engine Block | X | 1 | 1 | 2 |
| Exhaust Pipe | X | 1 | 2 | 3 |
| Transmission Assembly | X | 2 | 3 | 3 |

X through 3 describes range of the motion on the flap angles

FIG. 14

COOLING SYSTEM FOR INDUSTRIAL VEHICLE

TECHNICAL FIELD

This application relates to the field of industrial powered vehicles, including systems for cooling engine and/or transmission assemblies.

This application relates to the field of industrial powered vehicles, including systems for

BACKGROUND

Industrial vehicles by design may be used for a wide range of uses, duty cycles, and applications. In some operating conditions, industrial vehicles may be infrequently used to transport materials only when needed, e.g., in response to the occasional received shipment of goods. In other types of operating conditions, industrial vehicles may be used nearly around the clock in multiple shifts, with the only substantial down-time occurring during routine or required maintenance. Further, industrial vehicles may be exposed to a variety of environmental conditions ranging from near freezing temperatures in certain types of food handling/storage facilities, to very hot weather when operating in desert-like conditions. Some types of industrial vehicles, such as forklift trucks, may be tasked with having to frequently lift and lower heavy loads in addition to being driven and operated in the above described conditions. All of these activities may result in significant temperature variation to the engine, transmission, and other related components of the industrial vehicle at various stages of operation based, at least in part, on the workload and/or duration of work being performed.

Regardless of environmental temperatures, an internal combustion or diesel powered engine is generally considered "cold" prior to being started, and may need to be turned on for a period of time (typically some number of seconds) before it comes up to a predetermined operating temperature. At the predetermined operating temperature, the engine may be considered capable of efficiently generating power and/or of efficiently combusting fuel in order to limit the amount of emissions produced by the engine. However, the environmental temperatures can significantly affect the amount of time required to bring the engine up to operating temperature, and as a result the ability to operate the vehicle may be delayed.

When additional power demands are placed on the engine, such as when lifting or pushing heavy loads, the vehicle cooling system may not be able to adequately keep the engine and/or transmission sufficiently cool at all times. In some instances, one or more modes of vehicle operation may be restricted or prohibited in the event of engine or transmission overheating, which also impacts the availability of the vehicle to perform work. If the vehicle operating temperature becomes too high or is kept at an elevated value for a prolonged period of time, significant damage to the engine and/or transmission system may occur, potentially taking the vehicle out of service for an extended time.

This application addresses these and other problems.

BRIEF DESCRIPTION OF THE DRAWINGS

FIG. 14 illustrates an example chart indicating prioritized operating responses of a cooling system.

DETAILED DESCRIPTION

Figure 1:
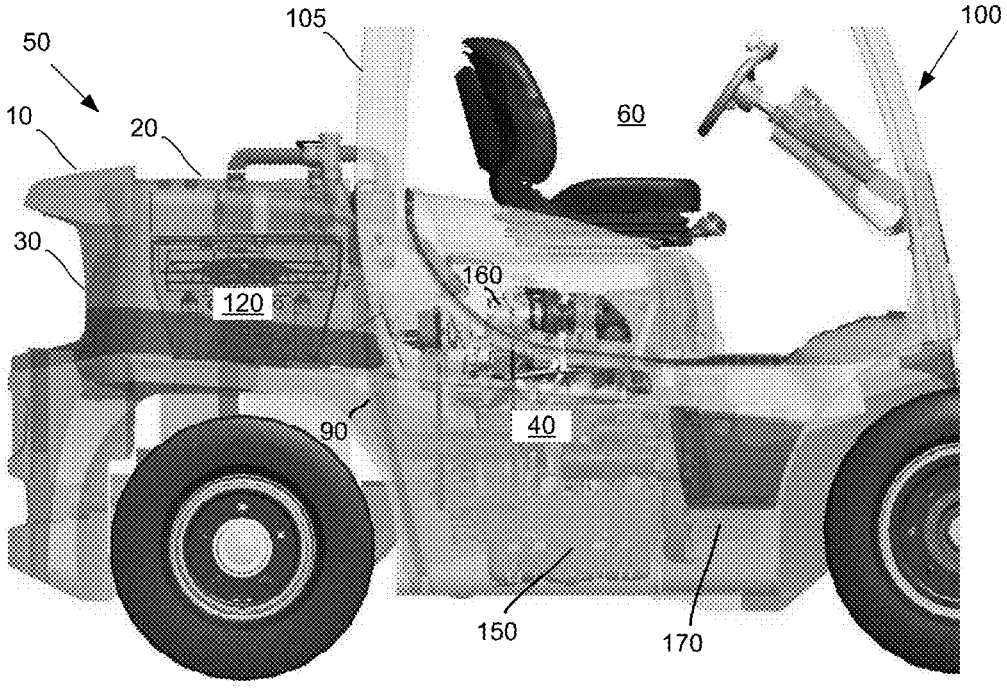
FIG. 1 illustrates a right-side external view of an example industrial vehicle.

FIG. 1 illustrates a right-side view of an industrial vehicle 100 including an example cooling system 50. An engine compartment 40 may be located in front of a vehicle counterweight 10. Additionally, engine compartment 40 may be located below an operator compartment 60. For industrial vehicles, such as a forklift truck, operator compartment 60 may comprise an operator seat mounted directly above engine compartment 40.

Cooling system 50 may comprise a control device 120, an intake 20 located in the top of counterweight 10, and an exhaust port 30 located in a rear opening of counterweight 10. The air that enters intake 20 may be directed by control device 120 to cool various components such as those found in engine compartment 40.

When an industrial vehicle is operated in a reverse direction (i.e., with counterweight pointed in the direction of travel), dust, debris, and/or contaminants from the surrounding air may enter through the opening in the rear of counterweight. However, by locating intake 20 above counterweight 10, the introduction of dust, debris, and/or contaminants from the air and/or ground into engine compartment 40 may be largely avoided. In some examples, air may be drawn into engine compartment 40 from below the industrial vehicle 100. Additionally, an air intake may be mounted to an overhead guard 105 to draw air into engine compartment 40 from above the industrial vehicle 100. In some examples, one or more radiators associated with cooling system 50 may be mounted to overhead guard 105.

Conventional cooling systems may include an air flush operation which may be accomplished by reversing the direction of rotation of a fan (e.g., a pusher, a blower, or both) in the cooling system to dislodge or blow out any of the dust, debris, or contaminants which has collected at one or more of the inlets, outlets, or radiators of the cooling system. Locating the intake 20 near the top of counterweight 10 may significantly reduce or eliminate the need to perform the air flush operation.

Engine compartment 40 may comprise various components, such as an engine head, an intake valve, an exhaust valve, an engine block, an exhaust pipe, a fuel injector, an alternator, cylinders, pistons, bearings, drive components, etc. Some of all of these components may be selectively cooled via cooling system 50. An engine head 160 may be located above one or more cylinders of an engine 150 housed in engine compartment 40. In some examples, engine head 160 may be configured as a combustion chamber to provide space for air and fuel to enter the engine cylinders. Additionally, one or more valves, spark plugs, and/or fuel injectors may be mounted to engine head 160.

Engine 150 may be connected to an exhaust system 90. Exhaust system 90 may comprise one or more exhaust pipes, mufflers, etc. Additionally, exhaust system 90 may comprise one or more emission control devices, such as a catalytic converter, configured to limit or control the emission of certain particulates that may result from the combustion of fuel within engine 150. The emission control devices may be configured to control or limit the emission of carbon monoxide, carbon dioxide, nitrogen oxide, hydrocarbons, other emissions, or any combination thereof.

Some types of emission control devices may operate more efficiently within a particular range of operating temperatures, e.g., above a minimum threshold operating temperature. For example, once the temperature associated with exhaust system 90, engine 150, and/or engine head 160 exceeds the minimum threshold operating temperature, the emission control device may be configured to reduce and/or control the amount of emissions within an allowable value (e.g., according to a regulatory or industry standard).

In one or more modes of operation, exhaust system 90 may either be considered an "open-loop" system, in which certain types of system feedback may not be available, or a "closed-loop" system, in which information from one or more sensors may be available. The one or more sensors may be configured to monitor the exhaust for compliance with emission requirements. At vehicle start up, exhaust system 90 may be considered an open-loop system, in which the input from the emission sensors may not be available. Accordingly, in some examples, engine 150 may be run for some predetermined period of time (e.g., approximately 10 seconds) at idle until it reaches a threshold operating temperature and the industrial vehicle 100 is allowed to fully operate. At normal operation, exhaust system 90 may enter the closed-loop mode of operation in which the sensors may be turned on to actively monitor the emissions and provide feedback to exhaust system 90 or a vehicle management system (e.g., an on-board processing device).

A transmission system 170 may be operatively connected to engine 150 via a transmission shaft and/or torque convertor. In some examples, the transmission linkage may be mechanical or hydrostatic. Additionally, transmission system 170 may comprise various other components such as clutch packs, gears, plates, shafts, etc. During certain types of operation of industrial vehicle 100, such as travelling up grade or when pushing a heavy load (e.g., "bulldozing"), transmission system 170 may heat up due to interactions between one or more of the clutch packs.

Industrial vehicle 100 may also comprise one or more hydraulic functions. A hydraulic assembly may comprise one or more devices configured to perform functions of lift, lower, rotate, move, extend, shift, clamp, release, open, close, other functions, or any combination thereof. One or more hydraulic function operator controls may be located within operator compartment 60.

The hydraulic assembly may comprise one or more hydraulic pumps, valves, etc. that are configured to provide hydraulic fluid at sufficient pressure to enable one of more hydraulic functions. In addition to providing power to a drive train for movement of industrial vehicle 100, an engine located in engine compartment 40 may be configured to provide power to the hydraulic pumps. Power demands may be placed on the engine to accommodate both vehicle traction and hydraulic function requests. In some examples, the hydraulic assembly may perform one or more hydraulic functions while industrial vehicle 100 is traveling.

Vehicle 100 is described with reference to an internal combustion engine forklift truck for illustrative purposes; however, one of skill in the art would appreciate that there are a number of different types of industrial vehicles which may be applicable to the systems and methods described herein. For example, other types of industrial vehicles include construction vehicles, dump trucks, forestry related vehicles, earth-moving vehicles, vehicles with cranes, etc. Additionally, certain types of industrial vehicles may be operated in various different environments and/or uses, such as mining enterprises, ports, harbors, airports, construction sites, warehouses, lumber yards, etc. Some types of industrial vehicles perform auxiliary functions, in addition to traction, such as a hydraulic lift function.

Figure 2:
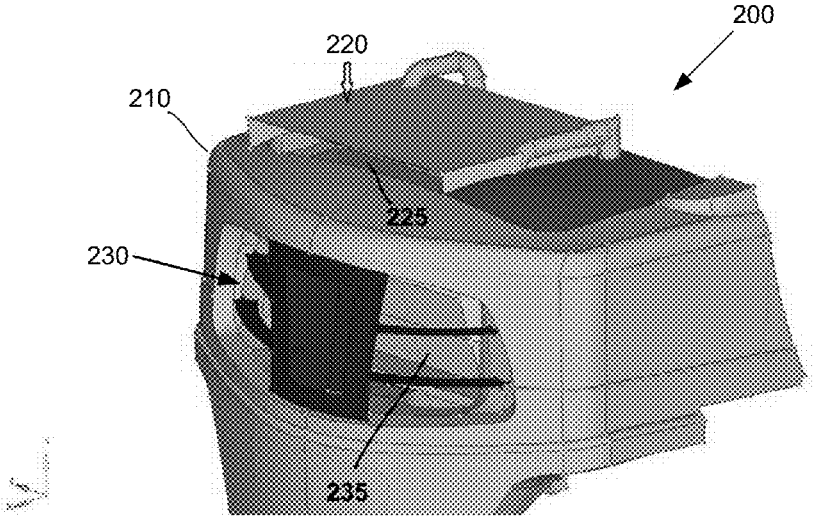
FIG. 2 illustrates an elevated partial right-side rear view of an example cooling system.

FIG. 2 illustrates an elevated partial right-side rear view of an example cooling system 200. Cooling system 200 may be installed in a counterweight 210. Counterweight 210 may be mounted or otherwise attached to a frame of an industrial vehicle, such as industrial vehicle 100 of FIG. 1. An air intake 220 may be located at or near the top surface of counterweight 210. Additionally, an exhaust port 230 may be located at or near the rear surface of counterweight 210. Air that enters intake 220 may be used to cool an engine radiator and/or other internal components of an industrial vehicle and then exit as heated air via exhaust port 230.

Intake 220 may comprise one or more inlet ports 225 that are configured to facilitate and/or direct the flow of air into cooling system 200. In some examples, intake 220 may comprise three inlet ports including two inlet ports located on either side of inlet port 225. Intake 220 may be closed in the direction facing an operator compartment in order to minimize or reduce the amount of noise that the operator is exposed to.

Inlet port 225 may be configured to increase the amount of airflow into cooling system 200 when the industrial vehicle is operating in a reverse direction. Additionally, when operating in reverse, airflow may enter exhaust port 230 and be used to cool one or more components. In some examples, a control device 235 may be located at or near exhaust port 230 to control the amount of airflow entering exhaust port 230 during reverse travel operations.

Operation of control device 235 may take into account the direction of the industrial vehicle and/or the amount of airflow that may be entering through exhaust port 230. For example, control device 235 may be configured to direct less airflow from exhaust port 230 into the engine compartment.

Figure 3A:
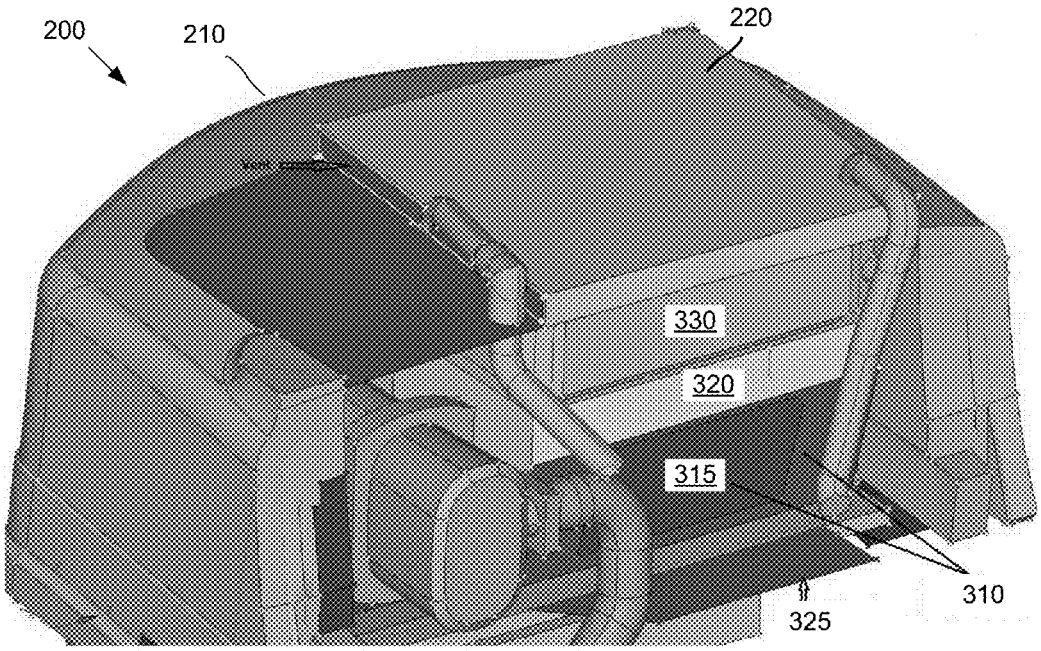
FIG. 3A illustrates a right-side internal view of the example cooling system of FIG. 2.

FIG. 3A illustrates an internal view of the example cooling system 200 of FIG. 2. Cooling system 200 may comprise one or more components, such as a fan 320, a control device 325, one or more radiators 330, such as an engine radiator and/or a transmission radiator, one or more pumps, other components, or any combination thereof.

In some examples, fan 320 may be configured to draw air from intake 220 so that the air passes through the one or more radiators 330. Fan 320 may be powered by the vehicle engine, or may be hydraulically powered so that it is not dependent on engine speed. The speed of fan 320 may be varied (e.g., increased or decreased) to vary the amount of airflow and/or to take into account the direction of travel of the industrial vehicle. For example, the speed of fan 320 may be decreased when the industrial vehicle is operating in reverse in which case the airflow may be augmented by air entering into the exhaust port 230 (FIG. 2). For a fan which is powered by a hydraulic system, a reduction in fan speed may decrease the power requirements placed on the hydraulic system and avoid any associated temperature increase.

Additionally, cooling system 200 may comprise a shroud 310 or other type of containment. Shroud 310 may be configured to house and/or be attached to one or more of the components of cooling system 200. Control device 325 may be configured to control the amount and/or direction of airflow that exits shroud 310 via one or more openings 315.

The one or more radiators 330 may be located on top of shroud 310 and/or on top of fan 320. An engine radiator may be fluidly coupled to an engine 350 located in an engine compartment. An engine coolant that circulates through the engine may pass through the engine radiator and in turn be cooled off by the air that is drawn through intake 220. Similarly, a transmission radiator may be fluidly coupled to a transmission system. A transmission fluid that circulates through the transmission system may pass through the transmission radiator and in turn be cooled off by the air that is drawn through intake 220. At least some of the air that is used to cool the one or more radiators 330 may exit industrial vehicle 200 at exhaust port 230. In some examples, exhaust port 230 may be located on an opposite side of shroud 310 as control device 325.

As discussed above, the location of intake 220 may be located at or near the top of counterweight 210. In addition to reducing and/or substantially eliminating the build-up of dust, debris, and/or contaminants, locating intake 220 near the top of counterweight 210 may allow the one or more radiators 330 and/or fan 320 to be placed horizontally.

Some types of components may achieve greater operating efficiencies and succumb to fewer maintenance issues when operated in the horizontal position rather than being operated in a vertical position. For example, by placing the one or more radiators 330 in a horizontal orientation, air bubbles and/or cavitations that may otherwise occur within the radiator and/or radiator hoses may be reduced or eliminated whether during operation or when filling the radiators with coolant.

By locating certain components in the horizontal orientation, the height of counterweight 210 may be reduced, which may lower the overall center of gravity of the industrial vehicle and increase lateral stability. Additionally, the airflow through exhaust port 230 may increase as a result of reorienting the surface areas of the one or more radiators in a horizontal plane, which may result in more efficient cooling of one or more of the vehicle components.

Fan 320 may be configured to create airflow from outside of the industrial vehicle into shroud 310. The airflow may pass through one or more radiators 330 into shroud 310. Additionally, fan 320 may be located below the one or more radiators 330. The one or more radiators 330 may be located in a generally horizontal orientation above shroud 310. In some examples fan 320 may be located in a generally horizontal orientation above or within shroud 310.

Fan 320 may be configured to draw air from above and/or outside of the industrial vehicle and down through the one or more radiators 330 in a generally vertical direction. In some examples, shroud 310 may be configured to redirect the airflow in a generally lateral direction after passing through one or more radiators 330. For example, a first portion of the airflow may be redirected out of industrial vehicle via exhaust port 230 (FIG. 2), and a second portion of the airflow may be redirected out one or more openings 315 to a plurality of components via control device 325. The portion of the airflow that is not directed to the plurality of components may primarily exit the industrial vehicle out of exhaust port 230.

Control device 325 may be operatively connected to shroud 310. Additionally, control device 325 may be configured to selectively direct at least a portion of the airflow to a plurality of components in the industrial vehicle after the airflow passes through one or more radiators 330. For example, control device 325 may be configured to preferentially direct a portion of the airflow into an engine compartment.

The exhaust port 230 (FIG. 2) may be located on an opposite side of shroud 310 as control device 325. Control device 325 may be configured to partially seal shroud 310. For example, control device 325 may be placed in a closed position, such that substantially all of the airflow that enters the partially sealed shroud 310 may exit out of exhaust port 230 rather than being directed into the engine compartment.

Control device 325 may comprise one or more flaps, baffles, doors, louvers, openings, valves, nozzles, ports, orifices, vanes, or any combination thereof. Additionally, control device 325 may be configured to control a direction and/or amount of airflow to one or more vehicle components such as an engine, an engine head, a transmission system, an exhaust system, other types of components, or any combination thereof. In some examples, control device 325 may be configured to preferentially direct and/or control airflow to the vehicle components according to one or more modes of operation of cooling system 200. Additionally, by controlling the direction of airflow out of shroud 310 and/or out of the industrial vehicle, cooling system 200 may be configured to prohibit air which has been heated by one or more of the components from passing back through one or more radiators 330.

Figure 3B:
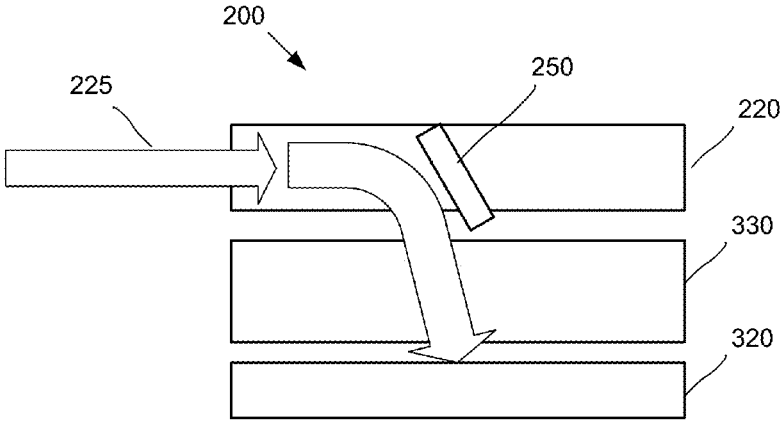
FIG. 3B illustrates the example cooling system of FIG. 2 including a baffle plate.

FIG. 3B illustrates the example cooling system 200 of FIG. 2 including a baffle 250. In some examples, baffle 250 may be integrated into intake 220 and may be configured to direct airflow 225 towards a center of fan 320 and/or a center of one or more radiators 330. By directing the airflow to the center of fan 320, the overall amount of the airflow may be increased due to the efficiencies of fan 320. In some examples, baffle 250 may be configured to direct at least a portion of the airflow towards opening 315 of shroud 310 (FIG. 3A).

Figure 4:
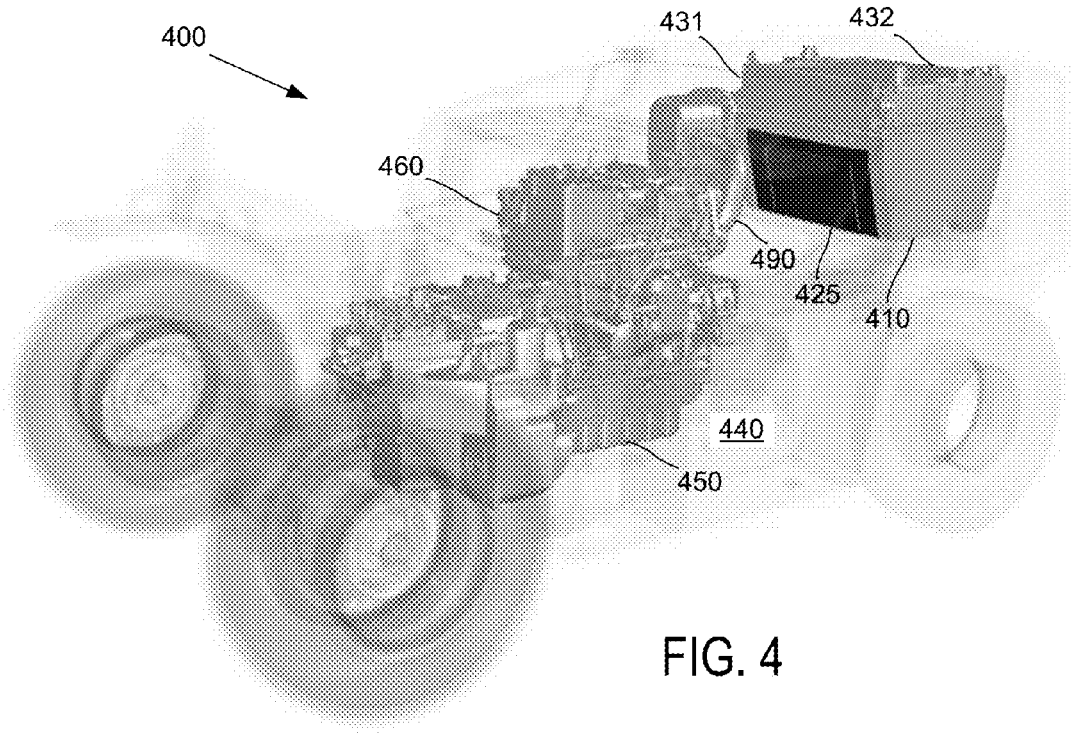
FIG. 4 illustrates an example cooling system in a first mode of operation.

FIG. 4 illustrates an example cooling system 400 in a first mode of operation. For example, the first mode of operation may be associated with vehicle start-up when an engine 450 is cold (e.g., at approximately ambient temperature). Engine 450 and/or an exhaust system 490 may operate more efficiently within a particular range of operating temperatures and/or above a threshold operating temperature. In the first mode of operation, a control device 425 of cooling system 400 may be located in a closed position.

In the closed position, control device 425 may be configured to impede and/or prohibit airflow from exiting out of a shroud 410 and into an engine compartment 440. For example, control device 425 may form a partially enclosed containment structure comprising the portion of the shroud 410 located adjacent to engine compartment 440, such that substantially all of the air entering through the cooling system intake is directed out of a cooling system exhaust port, such as exhaust port 230 (FIG. 2), after being used to cool an engine radiator 431 and/or a transmission radiator 432.

In the first mode of operation, any airflow through engine compartment 440 may be fairly insubstantial. In some examples, a belly pan may be attached to the bottom of the industrial vehicle to further enclose engine compartment 440 and form an essentially enclosed region during the first mode of operation. By limiting the amount of airflow in engine compartment 440 during the first mode of operation, the heat generated by engine 450 may be retained within engine compartment 440 to help increase the operating temperature associated with engine 450, an engine head 460, and/or other components located within engine compartment 440.

Increasing the rate of change in operating temperature of engine 450 may reduce the amount of time that exhaust system 490 requires to meet emission control standards, which in turn may allow industrial vehicle to begin normal operations in a more expedited manner. For example, instead of taking 10 or more seconds to warm up, engine 450 my warm up in less than half the time with control device 425 located in the closed position. The industrial vehicle and/or engine 450 may be placed in neutral or idle during the first mode of operation. In some examples, certain types of operation of the industrial vehicle may be restricted and/or prohibited during the first mode of operation.

Figure 5:
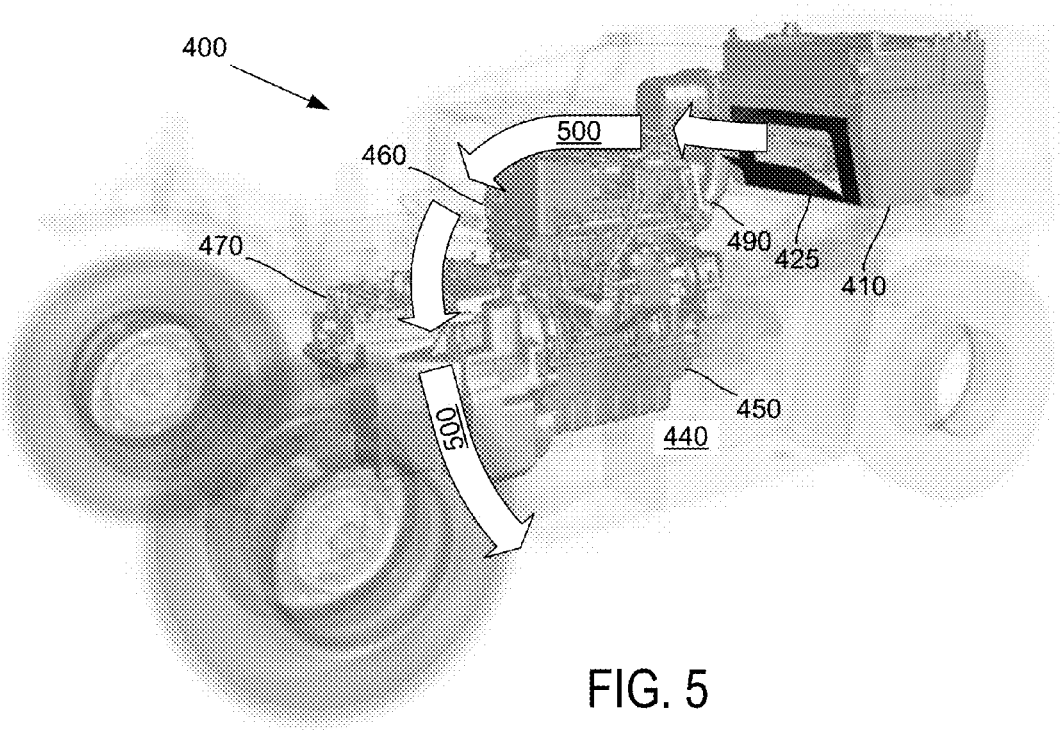
FIG. 5 illustrates the example cooling system of FIG. 4 in a second mode of operation.

FIG. 5 illustrates the example cooling system 400 of FIG. 4 in a second mode of operation. For example, the second mode of operation may be associated with vehicle operation after the operating temperature of engine 450 has exceeded a predetermined threshold value. In the second mode of operation, control device 425 may be configured to allow a first rate of airflow to exit out of shroud 410 and into engine compartment 440. For example, control device 425 may be opened and/or positioned to divert a first portion 500 of the air that enters through shroud 410 to flow into engine compartment 440.

In the second mode of operation, control device 425 may be configured to preferentially direct the first portion 500 of the airflow towards engine head 460. In some examples, the operating temperature associated with engine head 460 may be considered the highest priority of cooling system 400. As shown in FIG. 5, the first portion 500 of the airflow that exits shroud 410 may be directed to the upper portion of engine compartment 440 where engine head 460 resides.

By directing the airflow into the upper portion of engine compartment 440, a temperature associated with exhaust system 490, which may be located in a lower portion of engine compartment 440, may continue increasing up to an associated range of operating temperatures that more efficiently burns fuel and/or produces fewer emissions. Accordingly, the rates of change in temperature between various components may be separately altered according to a direction of the airflow through engine compartment 440. In some examples, rate of change in temperature of one component may be decreased by cooling system 400 while the rate of change of temperature of another component may be allowed to simultaneously increase.

After passing by engine head 460, the first portion 500 of the airflow may continue through engine compartment 440 until it reaches a transmission system 470. In some examples, cooling components in transmission system 470 may be considered a lower priority of cooling system 400. After cooling engine head 460 and/or transmission system 470, the first portion 500 of the airflow may exit out of industrial vehicle through one or more openings of the engine compartment 440 and/or one or more openings of the vehicle frame. The one or more openings may comprise spacing between portions of the frame and/or other openings located beneath engine compartment 440, for example. During the second mode of operation, the first portion 500 of the airflow may continuously be expelled out of the one or more openings to effectively form a barrier to dust and other types of foreign particles located on the ground and/or in the surrounding work environment from entering engine compartment 440.

Control device 425 may be mounted to shroud 410 by a hinge or pivot. A servo-motor or other type of activation device may be configured to controllably open control device 425 to a first open position. The first open position may be associated with a particular angle or aperture of control device 425. In examples where control device 425 is attached to shroud 410 by one or more hinges, the first open position may comprise an approximately thirty to forty five degree angle from vertical. Additionally, control device 425 may comprise a variable sized opening which may be made smaller or larger to vary the flow rate out of shroud 410 and into engine compartment 440.

Cooling system 400 may be configured to provide sufficient airflow to engine compartment 440 to maintain engine 450 and other components within a range of allowable or predetermined operating temperatures. For example, cooling system 400 may be configured to maintain a gasoline powered engine within an operating range of approximately 180 and 190 degrees Fahrenheit, to maintain a diesel powered engine within an operating range of approximately 190 and 200 degrees Fahrenheit, and/or to maintain a liquid propane gas (LPG) engine within an operating range of approximately 215 and 225 degrees Fahrenheit.

Figure 6:
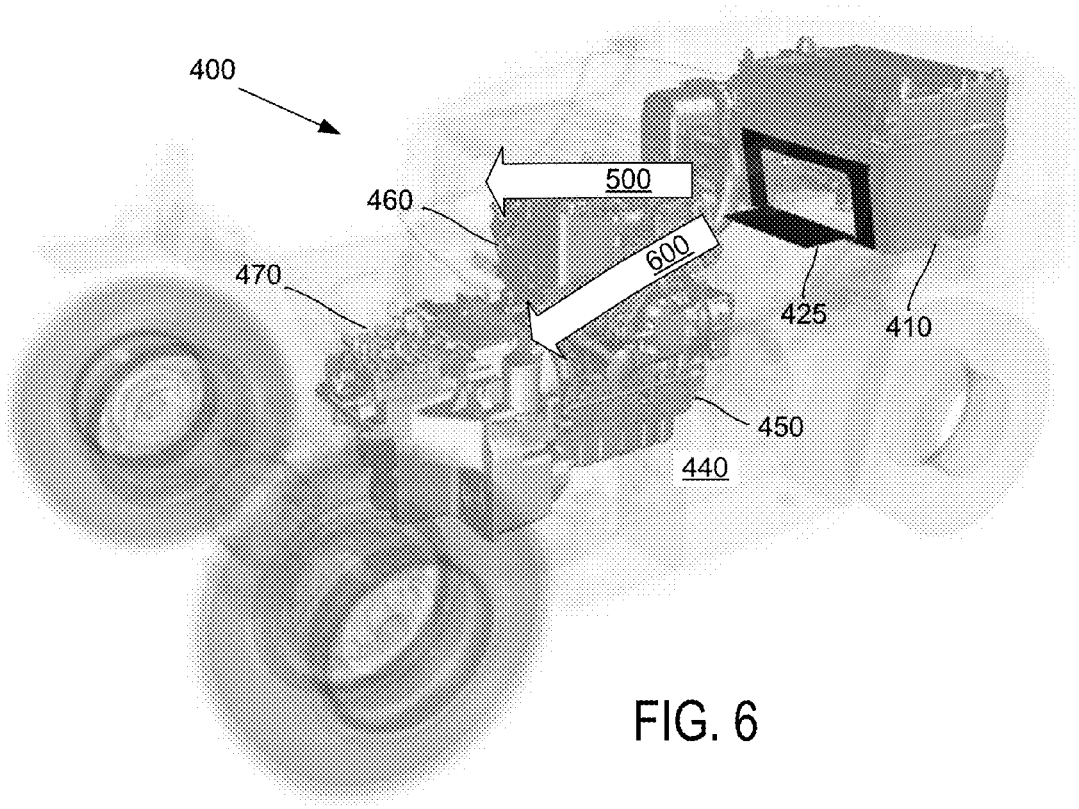
FIG. 6 illustrates the example cooling system of FIG. 4 in a third mode of operation.

FIG. 6 illustrates the example cooling system 400 of FIG. 4 in a third mode of operation. The third mode of operation may be associated with vehicle operation after the operating temperature of engine 450 has increased further beyond the temperatures associated with the second mode of operation. For example, the industrial vehicle may be engaged in medium-duty applications such as during vehicle travel and/or providing power for one or more hydraulic functions.

In the third mode of operation, control device 425 may be configured to allow a second rate of airflow to exit out of shroud 410 and into engine compartment 440. The second rate of airflow may be greater than the first rate of airflow associated with the second mode of operation. In some examples, control device 425 may be opened and/or positioned to divert a portion of the air that enters through shroud 410 to flow into a middle portion of engine compartment 440. The portion of the airflow directed across engine 450 may be approximately one third of the total airflow that enters shroud 410.

In the third mode of operation, control device 425 may be configured to preferentially direct the first portion 500 of the airflow towards engine head 460 while also directing a second portion 600 of the airflow into the engine body and/or engine block associated with engine 450. In some examples, the operating temperature associated with engine 450 may be considered the second highest priority of cooling system 400 as compared to the priority associated with cooling engine head 470. As shown in FIG. 6, the first portion 500 of the airflow that exits shroud 410 may be directed to the upper portion of engine compartment 440 where engine head 460 resides, and the second portion 600 of the airflow may be directed through the approximate middle of engine compartment 440 into and/or through engine 450.

The servo-motor or other type of activation device may be configured to controllably open control device 425 to a second open position. The second open position may be associated with a particular angle or aperture of control device 425. In some examples, the second open position may comprise an approximately forty five to ninety degree angle from vertical. Additionally, a variable sized opening associated with control device 425 may be made smaller or larger to vary the flow rate out of shroud 410 and into engine compartment 440.

As discussed above, engine 450 may operate more efficiently above a minimum threshold temperature for purposes of generating power, combusting fuel, and/or producing fewer emissions. Additionally, engine efficiency may decrease if engine 450 is operated above a maximum threshold temperature. The minimum and maximum threshold temperatures may be associated with a manufacturer designated operating range of engine 450. Similarly, other components such as engine head 460 and transmission system 470 may be associated with designated operating ranges of temperature.

Cooling system 400 may be configured to maintain these components within their designed operating ranges of temperature. One or more of the components may be associated with a higher priority. For example, a temperature associated with transmission system 470 may be allowed to exceed a maximum threshold temperature, perhaps momentarily, in order to maintain the temperature of engine head 460 and/or engine 450 within their respective designated operating ranges of temperature. Cooling system 400 may preferentially direct more or less of the airflow towards the components according to their respective priorities. In some examples, the priority for a particular component may vary depending on the operation being performed by the industrial vehicle.

After being used to cool engine head 460 and/or engine 450, one or both of the first portion 500 of the airflow and the second portion 600 of the airflow may continue through engine compartment 440 until it reaches transmission system 470. In some examples, cooling components in transmission system 470 may be considered a lower priority of cooling system 400 as compared to one or both of the cooling operations associated with engine head 470 and engine 450. After cooling engine head 460 and/or transmission system 470, the first portion 500 of the airflow and/or the second portion 600 of the airflow may exit out of the industrial vehicle through one or more openings.

Figure 7:
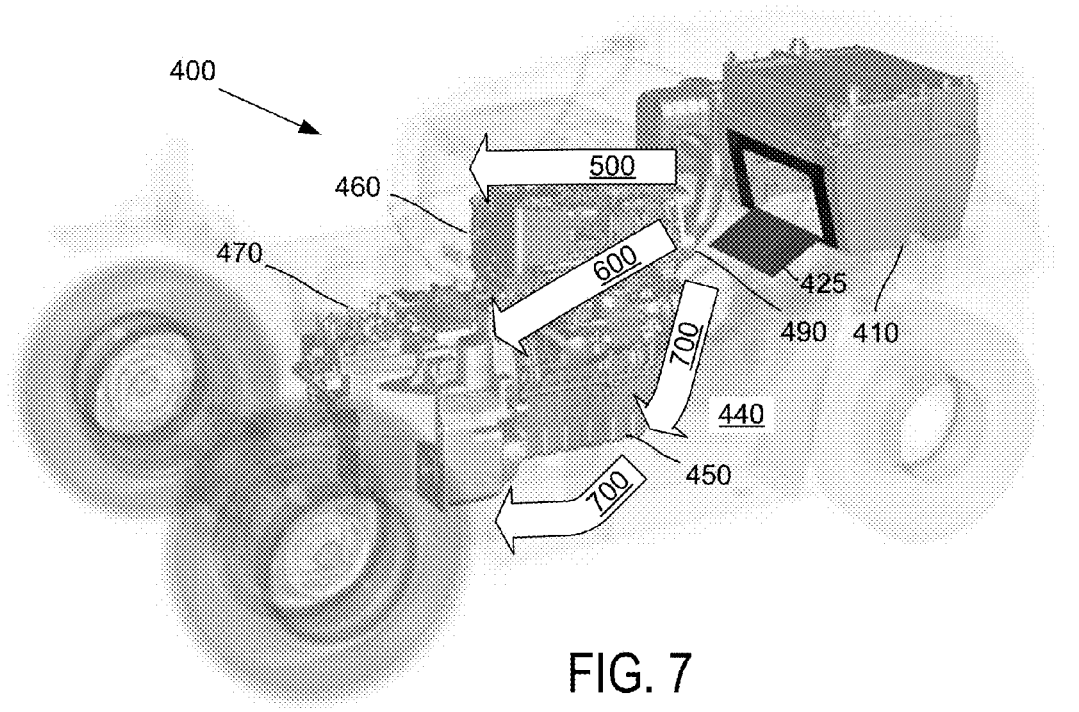
FIG. 7 illustrates the example cooling system of FIG. 4 in a fourth mode of operation.

FIG. 7 illustrates the example cooling system 400 of FIG. 4 in a fourth mode of operation. The fourth mode of operation may be associated with vehicle operation after the operating temperature of engine 450 has increased further beyond the temperatures associated with the third mode of operation. For example, the industrial vehicle may be engaged in heavy-duty applications associated with extended periods of operation, hill-climbing, performing multiple concurrent operations, bulldozing, or any combination thereof.

In the fourth mode of operation, control device 425 may be configured to allow a third rate of airflow to exit out of shroud 410 and into engine compartment 440. The third rate of airflow may be greater than either the first rate of airflow associated with the second mode of operation or the second rate of airflow associated with the third mode of operation. In some examples, control device 425 may be opened and/or positioned to divert a third portion 700 of the air that enters through shroud 410 to flow into a lower portion of engine compartment 440. Exhaust system 490 may be located in the lower portion of engine compartment 440.

In the fourth mode of operation, control device 425 may be configured to preferentially direct the first portion 500 of the airflow towards engine head 460, to direct the second portion 600 of the airflow into the engine body and/or engine block associated with engine 450, while also directing the third portion 700 of the airflow towards exhaust system 490 and/or transmission system 470. In some examples, the operating temperature associated with exhaust system 490 may be considered a lower priority of cooling system 400 as compared to the priority associated with cooling one or both of engine head 460 and engine 450.

The first portion 500 of the airflow that exits shroud 410 may be directed to the upper portion of engine compartment 440 where engine head 460 resides, the second portion 600 of the airflow may be directed through the approximate middle of engine compartment 440 into and/or through engine 450, and the third portion 700 of the airflow may be directed to the lower portion of engine compartment 440 where the airflow may continue beneath engine 450 into transmission system 470. In some examples, the operating temperature associated with transmission system 470 may be considered a lower priority of cooling system 400 as compared to the priority associated with cooling engine head 470, engine 450, and/or exhaust system 490.

The servo-motor or other type of activation device may be configured to controllably open control device 425 to a third open position. The third open position may be associated with a particular angle or aperture of control device 425. In some examples, the third open position may comprise an approximately ninety degree or greater angle from vertical. Additionally, a variable sized opening associated with control device 425 may be made smaller or larger to vary the flow rate out of shroud 410 and into engine compartment 440 and/or into transmission system 470. After being used to cool engine head 460, engine 450, exhaust system 490, and/or transmission system 470, one or more of the first portion 500, the second portion 600, and the third portion 700 of the airflow may exit out of the industrial vehicle through one or more openings.

Control device 425 may be configured to alternate between the closed position, the first open position, the second open position, the third position, and any combination thereof. A servo motor or actuation device may be configured to vary the position or aperture of control device 425 in a predetermined and/or cyclical pattern. In some examples, control device 425 may comprise a door or flap that repeatedly opens and closes through one or more positions in order to vary the direction and/or airflow rate to one or more of the components. The ability to selectively direct airflow to one or more of the components allows cooling system 400 to efficiently and individually control the temperature of the components using less overall airflow as compared to conventional systems.

The duration that control device 425 is located at or within one of the positions may be varied in order to preferentially apply a greater or lesser amount of airflow to each component. In some examples, control device 425 may be configured to pause or temporarily stop at each position for some period of time based, at least in part, on the priority of associated with the one or more components being cooled. In addition to varying the position and/or duration of control device 425, the speed of a fan may be increased or decreased to vary the amount of airflow that is initially drawn into shroud 410 and ultimately directed to any one of the components. In some examples, the fan axis or blade angle may be altered to vary the direction of airflow generated by the fan. Varying the speed and/or direction of the airflow may help reduce the likelihood of air stagnation or eddies from forming and/or help to address other airflow issues related to the effects of "swirl and tumble" within engine compartment 440. Additionally, more efficient use of the airflow may allow for the use of smaller radiators and/or fans in the industrial vehicle.

The position of control device 425 and/or the associated modes of operation may be performed and/or controlled by cooling system 400. For example, control device 425 may be configured to direct a portion of the airflow in a generally downward direction within engine compartment 440 in order to blow out any dust, debris, or other contaminants that may have entered otherwise accumulated in engine compartment 440. Control device 425 may be located in a position which is greater than ninety degrees from vertical in order to direct the airflow in the downward direction.

Figure 8:
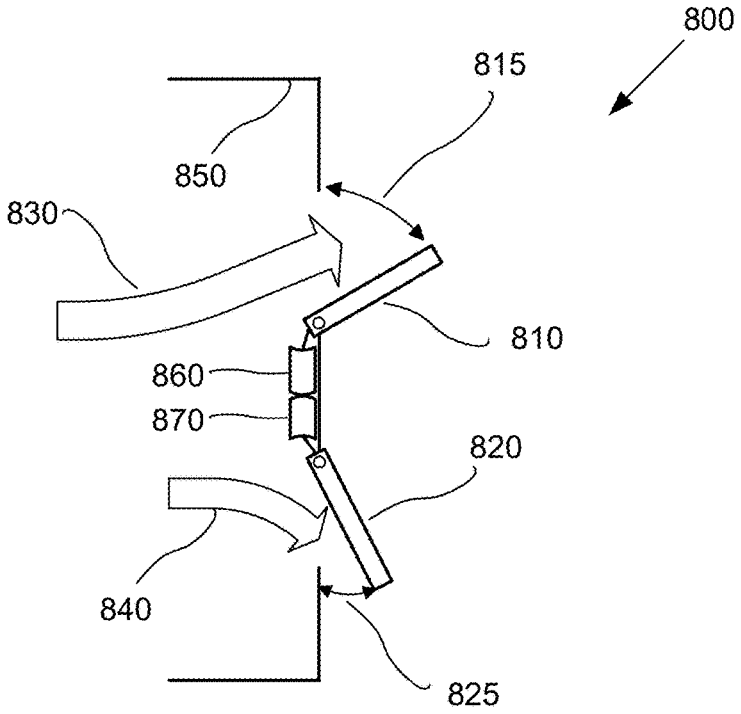
FIG. 8 illustrates an example cooling system comprising two or more louvers.

FIG. 8 illustrates an example cooling system 800 comprising two or more louvers, such as a first louver 810 and a second louver 820. One or more of the louvers may be mounted to containment 850. In some examples, containment 850 may comprise a shroud, a flow channel, an air intake, a containment structure, or any combination thereof. First louver 810 may be configured to allow a first airflow 830 to exit containment 850. First airflow 830 may be associated with a first air mass flow rate and/or a first direction of flow. One or both of the first air mass flow rate and first direction of flow may be determined, at least in part, by the operating position of louver 810.

Similarly, second louver 820 may be configured to allow a second airflow 840 to exit containment 850. Second airflow 840 may be associated with a second air mass flow rate and/or a second direction of flow. One or both of the second air mass flow rate and second direction of flow associated with second airflow 840 may be determined, at least in part, by the operating position of second louver 820.

One or more actuating devices 860, 870 may be configured to control the operating position of one or both of first louver 810 and second louver 820. In some examples, actuating devices 860, 870 may comprise one or more servo-motors. The operating positions of first louver 810 and second louver 820 may be independently or separately controlled from each other.

The operating position associated with first louver 810 may correspond to a first opening 815 and the operating position associated with second louver 820 may correspond to a second opening 825. The corresponding sizes of first opening 815 and second opening 825 may determine the air mass flow rates of first airflow 830 and second airflow 830, respectively. In the example where first opening 815 is larger than second opening 825, the air mass flow rate of first airflow 830 may be greater than the air mass flow rate of second airflow 840.

Additionally, the directions of flow associated with first airflow 830 and second airflow 830 may be controlled by the size and/or angle associated with first opening 815 and second opening 825, respectively. For example, first opening 815 may be associated with a first angle and second opening 825 may be associated with a second angle. The first and second angles may be measured from the face of containment 850, for example to identify an angle of first louver 810 and second louver 820, respectively.

In some examples, first louver 810 may be configured to control first airflow 830 in a generally upward direction and second louver 820 may be configured to control second airflow 840 in a generally downward direction. In other examples, first louver 810 may be configured to control first airflow 830 in a generally left-side direction and second louver 820 may be configured to control second airflow 840 in a generally right-side direction. The left-side direction may correspond to a left half of an engine compartment and the right-side direction may correspond to a right half of the engine compartment. In some examples and/or modes of operation, second louver 820 may be closed while first louver 810 is opened and, similarly, first louver 810 may be closed while second louver 820 is opened. Additionally, both louvers 810, 820 may be opened or closed at the same time as each other.

First louver 810 may be configured to move in relation and/or in response to movement of second louver 820, or vice versa. For example, the relative movement of both first louver 810 and second louver 820 may be coordinated to act together in a cohesive pattern depending on one or more modes of operation and/or based on input from one or more sensors.

Figure 9:
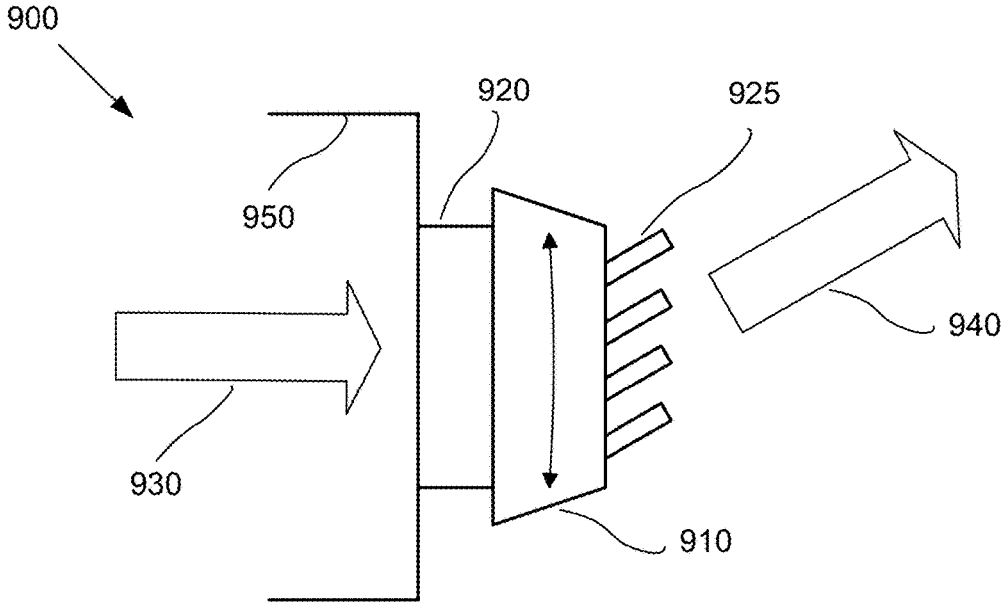
FIG. 9 illustrates a further example cooling system comprising a rotating control device.

FIG. 9 illustrates a further example cooling system 900 comprising a control device 910. Control device 910 may be mounted to containment 950. In some examples, containment 950 may comprise a shroud, a flow channel, an air intake, a containment structure, or any combination thereof. Control device 910 may be configured to allow an airflow 940 to exit containment 950. Airflow 940 may be associated with an air mass flow rate and/or a direction of flow. One or both of the air mass flow rate and direction of flow may be determined, at least in part, by the operating position of control device 910.

In some examples, control device 910 may be mounted to containment 950 via a hollow shaft 920. Hollow shaft 920 may be configured to allow air 930 located in containment 950 to pass into control device 910. Additionally, control device 910 may be configured to rotate about hollow shaft 920 in order to change the direction of flow of airflow 940. For example, according to the rotational position of control device 910, airflow 940 may be directed upwards, laterally, or downwards.

Control device 910 may comprise one or more vents 925 that are configured to alter the direction of air 930 from containment 950. The direction of airflow 940 may approximate the angle of the one or more vents 925. In some examples, the one or more vents 925 may be controlled to vary the air mass flow rate associated with airflow 940. For example, some or all of the one or more vents 925 may be separately closed and/or opened.

Figure 10:
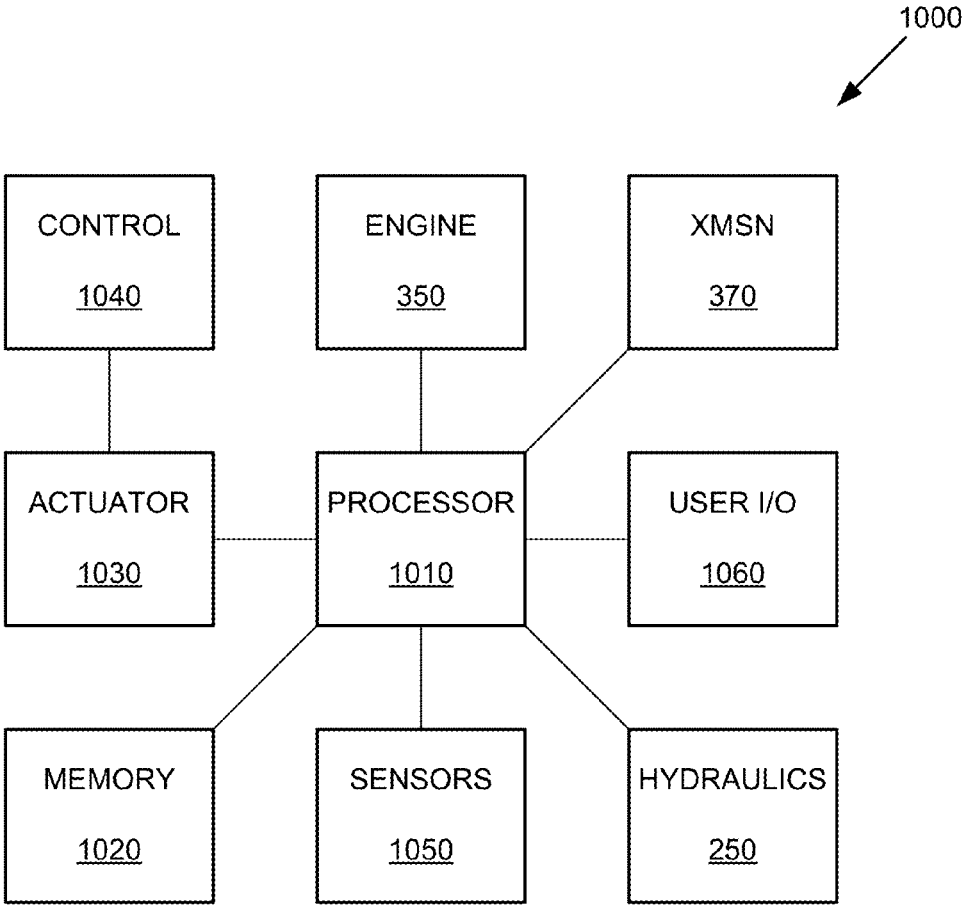
FIG. 10 illustrates a block diagram of an example cooling system.

FIG. 10 illustrates a block diagram of an example cooling system 1000. Cooling system 1000 may comprise a control device 1040 configured to control a flow rate and/or a direction of airflow to one or more components, such as an engine block, an engine head, a transmission system, other types of vehicle components, or any combination thereof. Control device 1040 may comprise one or more apparatus similar to that described in the present application, including FIGS. 1-9. Additionally, cooling system 1000 may comprise one or more of an actuator device 1030, a processing device

1010, a memory device 1020, one or more sensors 1050, a user input/output (I/O) device 1060, or any combination thereof.

Actuator device 1030 may be controlled by processing device 1010. For example processing device 1010 may be configured to analyze various vehicle input, vehicle output, and/or other types of operational data, and to provide actuator device 1030 with one or more instructions for operating control device 1040. In some examples, processing device 1010 may comprise or be communicatively coupled with memory device 1020. Memory device may be configured to store information associated with the vehicle input, vehicle output, and/or other types of operational data. Additionally, memory device may be configured to store predetermined values, thresholds, and/or instructions associated with operation of control device 1040 and/or with one or more of the components in cooling system 1000.

Processing device 1010 may be configured to receive input and/or output from one or more sensors 1050. For example, the one or more sensors 1050 may receive information related to engine temperature, transmission temperature, radiator temperature, ambient temperature, engine speed, clutch pack engagement, vehicle speed, direction of travel, hydraulic lift, hydraulic effort, hydraulic pressure, other types of vehicle information, and/or any combination thereof. In some examples, processing device 1010 may communicate directly with or receive information from engine 150, transmission system 170, and/or hydraulic system 150 to determine one or more of the information discussed with respect to the one or more sensors 1050.

Additionally, processing device 1010 may be configured to receive data from, or transmit data to, user I/O device 1060. User I/O device 1060 may comprise one or more devices associated with a vehicle operator and/or a vehicle technician. The vehicle operator or vehicle technician may communicate operational data or criteria to processing device 1010 via a user interface, a diagnostic tool, or other types of I/O device 1060. For example, I/O device 1060 may be used to inform processing device 1010 of an expected vehicle duty cycle, an ambient operating temperature or weather conditions, a maximum transport load or capacity of the vehicle, instructions for operation, a code associated with the instructions for operation, other types of information, or any combination thereof. In some examples, I/O device 1060 may be used to request a particular angle of operation and/or amount of airflow associated with control device 1040 during one or more modes of operation of cooling system 1000.

Based, at least in part, on one or more inputs and/or outputs received from the various components of cooling system 1000, processing device 1010 may be configured to instruct actuator 1030 and/or control device 1040 to vary the direction, priority, and/or amount of airflow associated with cooling system 1000.

In some examples, cooling system 1000 may comprise means for radiating heat generated by a plurality of components in the industrial vehicle, such as engine 150 and/or transmission system 170. The means for radiating may be located in a containment structure. The means for radiating may comprise one or more radiators configured to circulate a liquid coolant through at least one of the plurality of components located in an engine compartment. Additionally, cooling system 1000 may comprise means for creating airflow from outside of the industrial vehicle into the containment, such as a fan, an impeller, a suction device, etc. The airflow may pass through the means for radiating heat.

Cooling system 1000 may comprise means for selectively directing at least a portion of the airflow to the plurality of components in the industrial vehicle after the airflow passes through the one or more means for radiating. In some examples, the means for selectively directing may comprise means for varying an amount of the portion of the airflow that is directed to each of the plurality of components in the industrial vehicle.

Control device 1040 may be actuated and/or controlled by actuator device 1030. For example, actuator device 1030 may be configured to open, close, and/or adjust an angle of operation associated with control device 1040, to vary a direction of control device 1040, to vary the size of an aperture, valve, and/or opening associated with control device 1040, to perform other functions associated with control device 1040, or any combination thereof.

Control device 1040 and/or actuator device 1030 may comprise means for selectively directing the portion of the airflow into an engine compartment. For example, control device 1040 may be configured to direct a first portion of the airflow towards an engine head during a first mode of operation and to direct a second portion of the airflow towards an engine block during a second mode of operation. In some examples, the first portion of the airflow continues to be directed towards the engine head during the second mode of operation. An overall amount of the airflow directed into the engine compartment during the second mode of operation may be greater than the first portion of the airflow directed into the engine compartment during the first mode of operation.

Additionally, control device 1040 may be configured to direct a third portion of the airflow towards a transmission system during a third mode of operation. During the third mode of operation, the first portion of the airflow may continue to be directed towards the engine head and the second portion of the airflow may continue to be directed towards the engine block.

Figure 11:
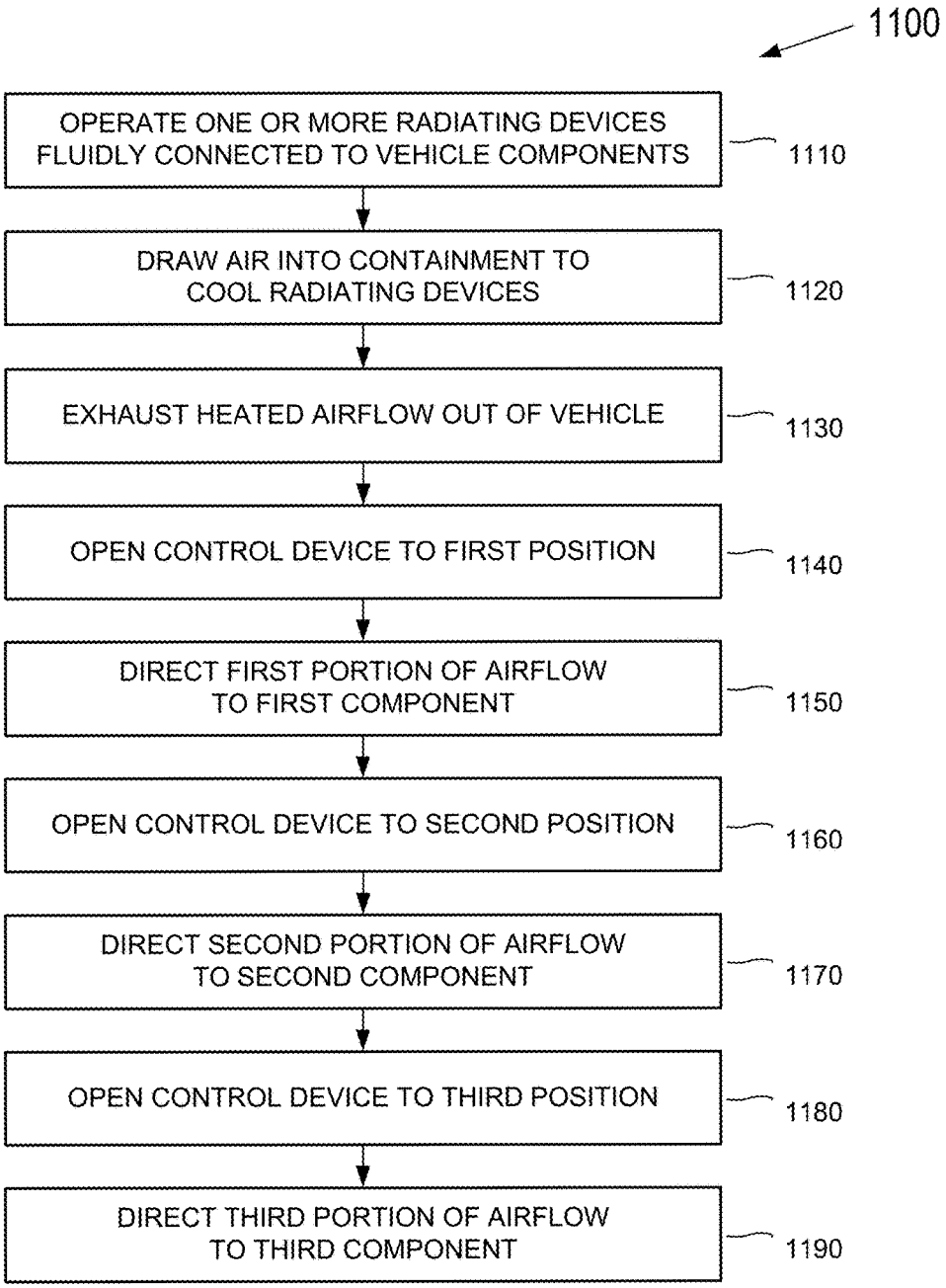
FIG. 11 illustrates an example process of cooling an industrial vehicle.

FIG. 11 illustrates an example process 1100 of cooling an industrial vehicle. At operation 1110, one or more radiating devices may be operated to radiate heat generated by a plurality of components in the industrial vehicle, such as an engine and/or a transmission assembly. The one or more radiating devices may be located in a containment structure. In some examples, the containment structure may be located within a counterweight of a forklift.

At operation 1120, airflow may be created by drawing air from outside of the industrial vehicle into the containment. The airflow may pass through the one or more radiating devices after being drawn into the containment.

At operation 1130, substantially all of the airflow that enters the containment may exit out of an exhaust port of the industrial vehicle. A control device may selectively direct at least a portion of the airflow to the plurality of components in the industrial vehicle after the airflow passes through the one or more radiating devices. In some examples, substantially all of the airflow that enters the containment exits out of the exhaust port when the control device is in a closed position. The control device may be mounted, attached, or otherwise located on one side of the containment, and the exhaust port may be located on an opposite side of the containment.

At operation 1140, the control device may be opened and/or otherwise placed in a first position. The first position may be associated with an angle of operation, an aperture size, a number of openings, a rotational orientation of the control device, a throttle diameter, other operating positions, or any combination thereof.

At operation 1150, the control device may selectively direct a first portion of the airflow to an engine head when the control device is placed in the first position.

At operation 1160, the control device may be opened and/or otherwise placed in a second position. The second position may be associated with an angle of operation, an aperture size, a number of openings, a rotational orientation of the control device, a throttle diameter, other operating positions, or any combination thereof.

At operation 1170, the control device may selectively direct a second portion of the airflow to an engine block. In some examples, the first portion of the airflow may continue to be directed to the engine head with the control device placed in the second position.

At operation 1180, the control device may be opened and/or otherwise placed in a third position. The third position may be associated with an angle of operation, an aperture size, a number of openings, a rotational orientation of the control device, a throttle diameter, other operating positions, or any combination thereof.

At operation 1190, the control device may selectively direct a third portion of the airflow to a transmission system. In some examples, both the first portion of the airflow may continue to be directed to the engine head and the second portion of the airflow may continue to be directed to the engine block while the control device is placed in the third position.

Additionally, the control device may be selectively closed, opened, and/or placed in either the closed position, the first position, the second position, or the third position in response to receiving input associated with one or more of the vehicle components and/or systems. For example, various sensor input and/or vehicle output may be received by a processing device and/or actuation device, which in turn may be used to determine an operating position for control device. The input and/or output may comprise engine temperature, transmission temperature, ambient temperature, engine speed, clutch pack engagement, vehicle speed, hydraulic lift, hydraulic effort, hydraulic pressure, other types of vehicle information, and/or any combination thereof.

Process 1100 and the associated operations described therein, may be performed by one or more processing devices, such as processing device 1010 of FIG. 10. For the sake of convenience, the operations are described as various interconnected functional blocks or diagrams. This is not necessary, however, and there may be cases where these functional blocks or diagrams are equivalently aggregated into a single logic device, program or operation with unclear boundaries.

The system and apparatus described above may use dedicated processor systems, micro controllers, programmable logic devices, microprocessors, or any combination thereof, to perform some or all of the operations described herein. Some of the operations described above may be implemented in software and other operations may be implemented in hardware. One or more of the operations, processes, and/or methods described herein may be performed by an apparatus, a device, and/or a system substantially similar to those as described herein and with reference to the illustrated figures.

The processing device may execute instructions or "code" stored in memory. The memory may store data as well. The processing device may include, but may not be limited to, an analog processor, a digital processor, a microprocessor, a multi-core processor, a processor array, a network processor, or the like. The processing device may be part of an integrated control system or vehicle system manager, or may be provided as a portable electronic device that may be configured to interface with a networked system, locally and/or remotely, via a wireless transmission.

Figure 12:
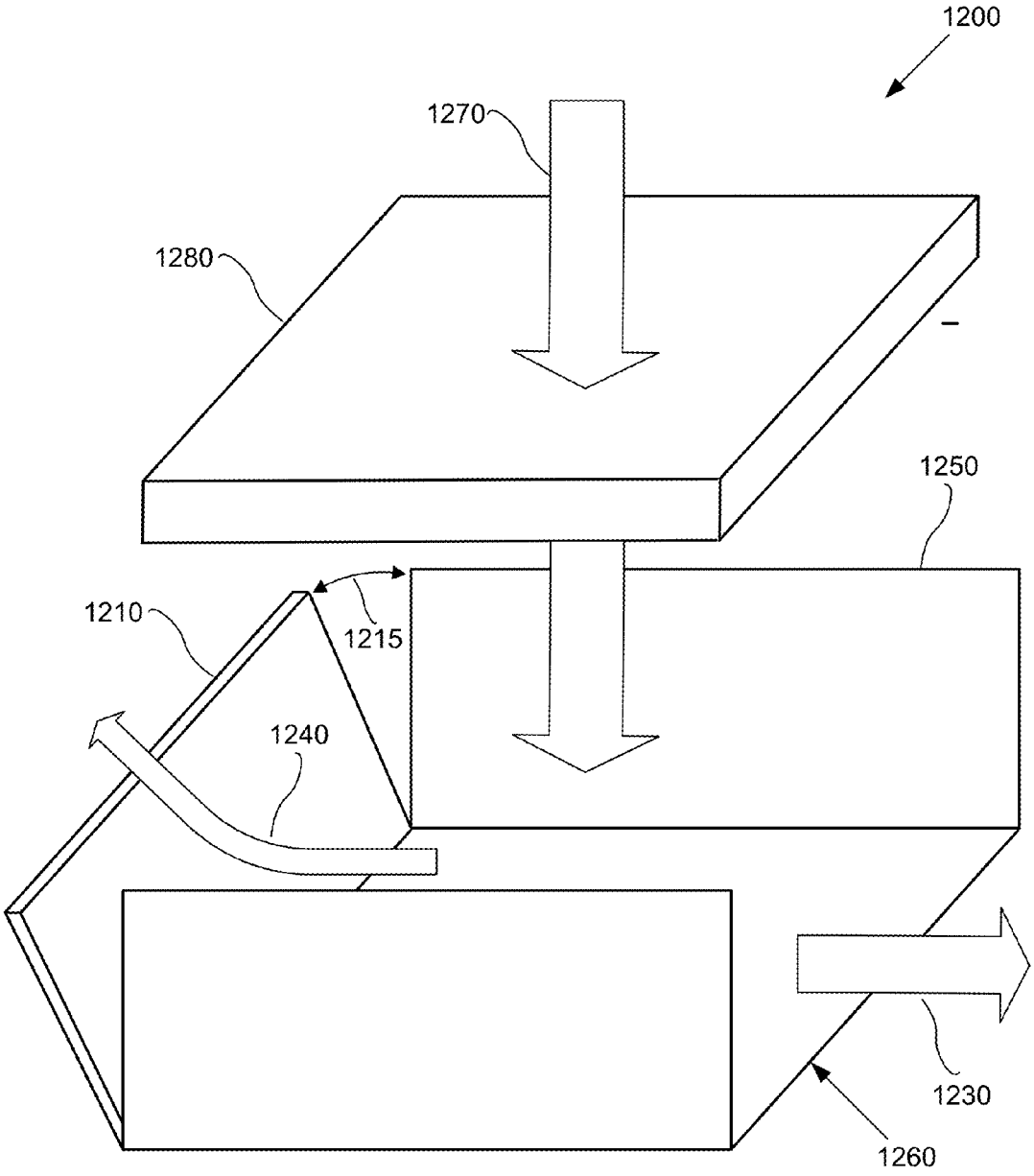
FIG. 12 illustrates an example cooling system for providing directional airflow control.

FIG. 12 illustrates an example cooling system 1200 for providing directional airflow control. One or more control devices 1210 may be mounted to a containment 1250. In some examples, containment 1250 may comprise two side walls and a floor. An exhaust vent 1260 may be formed between the two side walls and the floor. Control device 1210 may be located on an opposite side of containment 1250 as exhaust vent 1260. In some examples, the top of containment 1250 may form an opening.

Airflow 1270 drawn into containment 1250 may initially pass through a radiator 1280. In some examples, the direction of airflow 1270 through radiator 1280 is in a generally vertical direction. Radiator 1280 is shown in a raised position above containment 1250 for illustrative purposes. However, in some examples, radiator 1280 may fit on, or partially within, containment 1250. After passing through radiator 1280, airflow 1270 may be diverted at an approximate right angle. For example, some or all of airflow 1270 may be diverted in a generally horizontal direction out exhaust vent 1260 as first airflow 1230.

Control device 1210, shown as a simple flap for illustrative purposes, may be configured to open to one or more positions. Additionally, control device 1210 may be configured to allow a second airflow 1240 to exit containment 1250. Second airflow 1240 may be associated with a second air mass flow rate and/or a second direction of flow. One or both of the second air mass flow rate and second direction of flow may be determined, at least in part, by the operating position of control device 1210. For example, control device 1210 may be associated with an angle 1215. The direction of second airflow 1240 may approximate angle 1215.

Control device 1210 may be mounted to containment 1250 by a hinge. The hinge may comprise a generally horizontal axis, such that control device 1210 may be configured to control second airflow 1240 in a generally upward direction. In other examples control device 1210 may be configured to control second airflow 1240 in a generally horizontal direction, or a generally downward direction. In some examples, the hinge may comprise a generally vertical axis, such that control device 1210 may be configured to control second airflow 1240 in a generally left to right direction.

In some examples and/or modes of operation, control device 1210 may be closed such that second airflow 1240 may be reduced to a near zero air mass flow rate. In that case, substantially all of airflow 1270 may exit containment 1250 as first airflow 1230 out of exhaust vent 1260.

Figure 13:
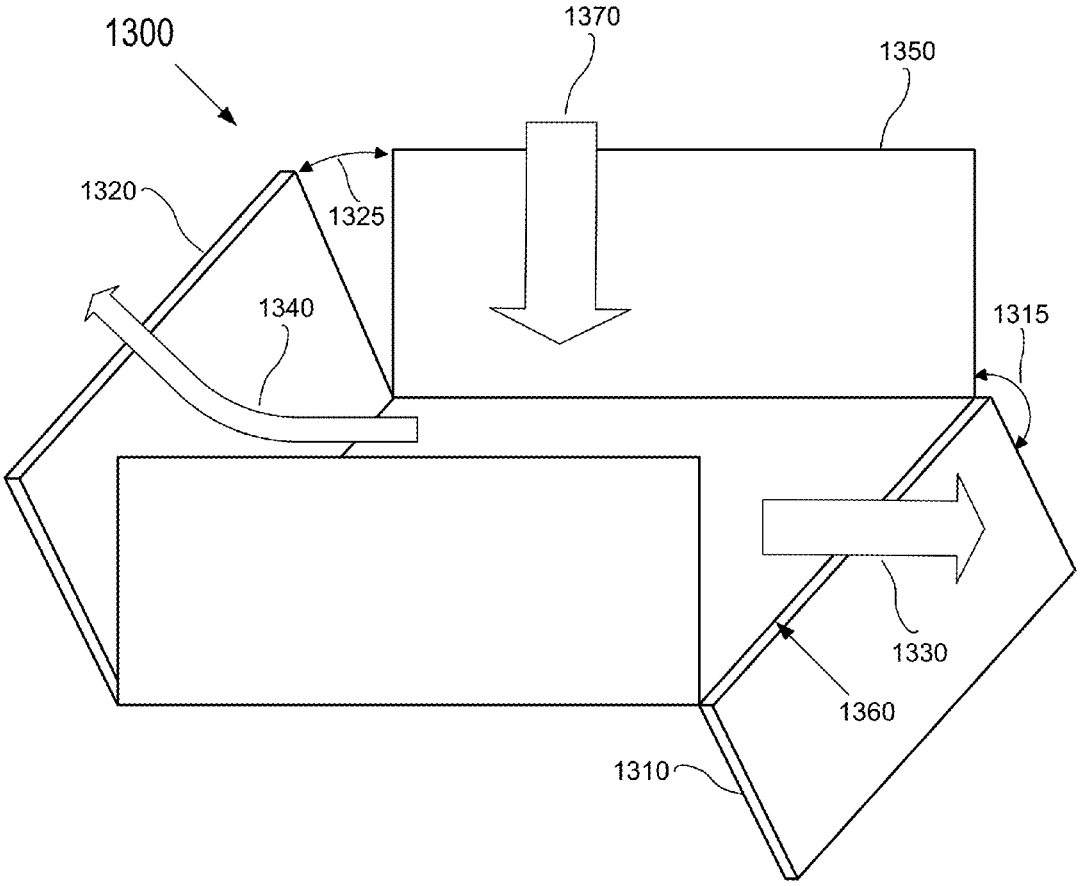
FIG. 13 illustrates a further example cooling system for providing directional airflow control.

FIG. 13 illustrates a further example cooling system 1300 for providing directional airflow control. Cooling system 1300 may comprise one or more control devices including a first control device 1310 and a second control device 1320. One or both of first control device 1310 and second control device 1320 may be mounted to a containment 1350. In some examples, containment 1350 may comprise two side walls and a floor. First control device 1310 may be located on an opposite side of containment 1350 as second control device 1320. First control device 1310 may be configured to direct air out an exhaust vent 1360.

Airflow 1370 drawn into containment 1350 may initially pass through one or more radiators in a generally vertical direction. At least a portion of airflow 1370 may be diverted in a generally horizontal direction out exhaust vent 1360 as first airflow 1330.

First control device 1310, shown as a simple flap for illustrative purposes, may be configured to open to one or more positions. Additionally, first control device 1310 may be configured to allow first airflow 1330 to exit containment 1350. An air mass flow rate and/or a direction of flow associated with first airflow 1330 may be determined, at least in part, by the operating position of first control device 1310. For example, first control device 1310 may be associated with an angle 1315.

First control device 1310 is shown mounted to containment 1350; however, in some examples, first control device 1310 may be mounted to a counterweight at or near an exhaust port, such as exhaust port 230 (FIG. 2).

In some examples and/or modes of operation, first control device 1310 may be completely open, while second control device 1320 is closed, such that first airflow 1330 has approximately the same air mass flow rate as airflow 1370. In that case, substantially all of airflow 1370 may exit containment 1350 as first airflow 1330 out of exhaust vent 1360.

Second control device 1320 is also shown as a simple flap for illustrative purposes, and may be configured to open to one or more positions. Additionally, second control device 1320 may be configured to allow a second airflow 1340 to exit containment 1350. A second air mass flow rate and/or a second direction of flow associated with second airflow 1340 may be determined, at least in part, by the operating position of second control device 1320. For example, second control device 1320 may be associated with a second angle 1325. The direction of second airflow 1340 may approximate second angle 1325.

Second control device 1320 may be mounted to containment 1350 by a hinge. The hinge may comprise a generally horizontal axis, such that second control device 1320 may be configured to control second airflow 1340 in a generally upward direction. In other examples second control device 1320 may be configured to control second airflow 1340 in a generally horizontal direction, or a generally downward direction. In some examples, the hinge may comprise a generally vertical axis, such that second control device 1320 may be configured to control second airflow 1340 in a generally left to right direction.

In some examples and/or modes of operation, first control device 1330 may be closed such that first airflow 1330 may be reduced to a near zero air mass flow rate and second airflow 1340 has approximately the same air mass flow rate as airflow 1370. In that case, substantially all of airflow 1370 may exit containment 1350 as second airflow 1340 into an engine compartment. The position of first control device 1310 may be controlled to vary the rate associated with first airflow 1330 and the position of second control device 1320 may be controlled to vary the rate associated with second airflow 1340.

FIG. 14 illustrates an example chart indicating prioritized operating responses of a cooling system 1400. In a first mode of operation, such as during a vehicle start-up or when operating in a cold ambient operating condition, one or more control devices may be closed (as denoted by an "X" in the chart). By closing the one or more control devices, airflow may be reduced or prohibited from being directed to the engine head, engine block, exhaust pipe, transmission assembly, other components, or any combination thereof.

In a second mode of operation, such as when the industrial vehicle is being operated for light-duty tasks, as determined by frequency and/or effort, the engine head, engine block, and exhaust pipe may be associated with a higher priority than the transmission assembly. Accordingly, more airflow may be directed to the engine and exhaust system than the transmission assembly. A position, angle, or duration of the one or more control devices may be varied to provide the different rates of airflow to the components. For example, a control device may be configured to direct airflow in a first position for a duration that is three times as long as when the control device is located in a second position. The control device may be alternately located in the first and second position in a cyclical manner.

In a medium-duty mode of operation, the engine head and engine block may be associated with the highest priority, the exhaust pipe may be associated with a medium priority, and the transmission assembly may be associated with a lower priority. The control device may be configured to alternate between three or more positions in a cyclical manner to effectuate different amounts of flow rate to the components. For example, the control device may be configured to direct airflow in the first position for a duration that is two times as long as when the control device is located in either the second position or a third position.

In a heavy-duty mode of operation, the engine head may be associated with the highest priority, the engine block may be associated with a medium priority, and the exhaust pipe and transmission assembly may be associated with a lower priority. The control device may be configured to alternate between three or more positions in a cyclical manner to effectuate different amounts of flow rate to the components. For example, the control device may be configured to direct airflow in the third position for a duration that is two times as long as when the control device is located in either the first position or the second position.

Figure 15:
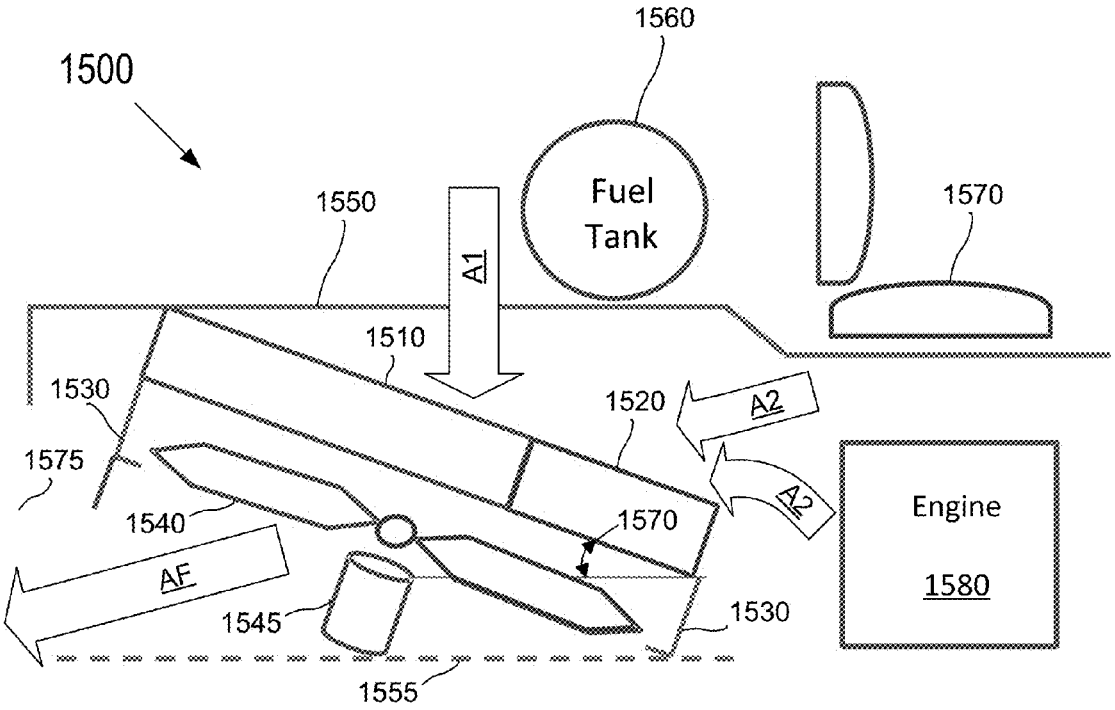
FIG. 15 illustrates an example cooling system for providing directional airflow control.

FIG. 15 illustrates an example cooling system 1500 for providing directional airflow control. Cooling system 1500 may comprise one or more radiators, such as an engine radiator 1510 and a transmission radiator 1520 located within a cavity 1555 of a vehicle 1550. In some examples cavity 1555 may be formed within a counterweight of an industrial vehicle, such as a forklift truck.

Vehicle 1550 may comprise an externally located fuel tank 1560 mounted on a top surface of the counterweight, and an operator seat 1570 located above an engine compartment 1580. Engine radiator 1510 and transmission radiator 1520 may be located between engine compartment 1580 and an exhaust port 1575.

A fan 1540 located underneath engine radiator 1510 and transmission radiator 1520 may be configured to draw airflow A1 from above vehicle 1550, through engine radiator 1510 and transmission radiator 1520, and out an exhaust port 1575 as exhaust AF. Fan 1540 may be powered by an electric motor 1545.

In addition to airflow A1, fan 1540 may be configured to draw secondary airflow A2 from within and/or through engine compartment 1580. A sealed containment structure 1530 may be configured to prohibit heated exhaust AF from being circulated back through engine radiator 1510 and transmission radiator 1520.

Some or all of engine radiator 1510, transmission radiator 1520, and fan 1540 may be oriented at a tilted angle 1570 within cavity 1555. In some examples, angle 1570 may be approximately 30 degrees from horizontal. Angle 1570 may facilitate additional secondary airflow A2 from within engine compartment 1580 which may also operate to reduce the amount of heat which is experienced at operator seat 1570. In some examples, the amount of angle 1570 may be varied to control the airflow through cooling system 1500. For example, the pitch or angle of the blades of fan 1540 may be adjusted, or the entire fan 1540 may be tilted to vary the direction and/or amount of airflow that fan 1540 generates.

In some examples, transmission radiator 1520 may be positioned above engine radiator 1510, such that airflow A1 flows through the radiators sequentially. In other examples, engine radiator 1510 may be positioned above transmission radiator 1520. Locating one of the radiators above the other may allow for preferentially cooling one radiator before the other.

Figure 16:
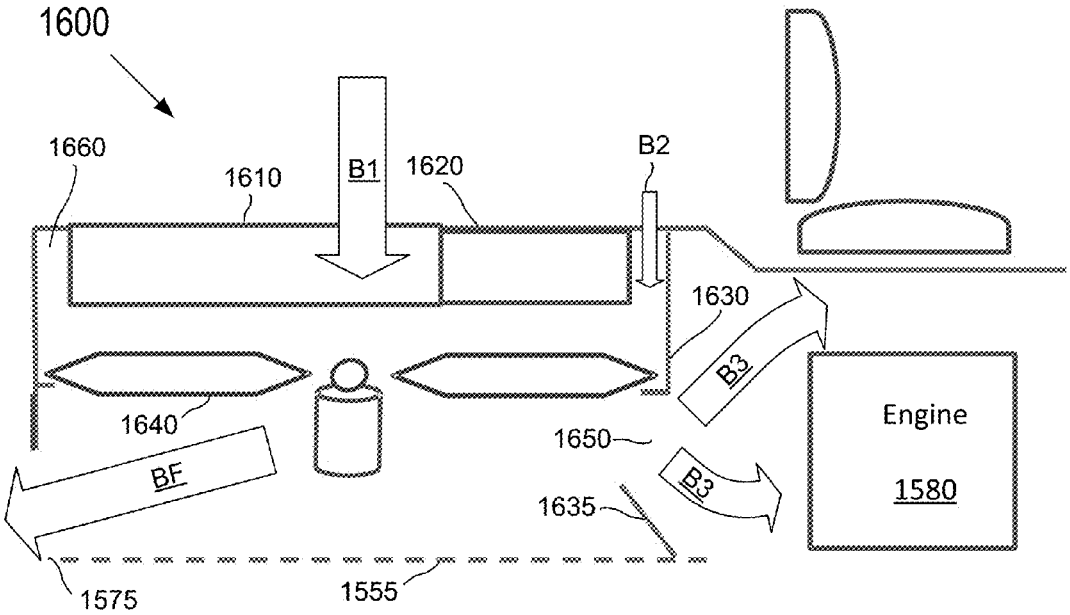
FIG. 16 illustrates another example cooling system for providing directional airflow control.

FIG. 16 illustrates another example cooling system 1600 for providing directional airflow control. Cooling system 1600 may comprise one or more radiators, such as an engine radiator 1610 and a transmission radiator 1620 placed in a generally horizontal orientation within the cavity 1555. A fan 1640 may be configured to draw airflow B1 through engine radiator 1610 and transmission radiator 1620 in a generally vertical direction from outside of the vehicle.

A portion of airflow B1 drawn into cavity 1555 may be directed out of the exhaust port 1575 as exhaust BF, and another portion of airflow B1 may be directed into or through the engine compartment 1580 as airflow B3. Airflow B3 may be directed out of an opening 1650 formed between radiator/fan containment 1630 and a louver 1635 located near the bottom of cavity 1555.

One or more gaps 1660 may be provided next to the one or more radiators. The gaps 1660 may be configured to provide an additional path for a secondary airflow B2 to enter cavity 1555. In some examples, the diameter of fan 1640 may be larger than the width of the one or more radiators such that secondary airflow B2 may be drawn from above the vehicle and pass through gaps 1660 into cavity without passing through the one or more radiators. In some examples, the one or more radiators and/or fan 1640 may be laterally centered within containment 1630.

Louver 1635 may be configured to open, close, and/or include an adjustable angle to redirect a portion of airflow B1 and/or secondary airflow B2 through opening 1650. In some examples, louver 1635 may be configured to close opening 1650, such as during engine startup.

Figure 17:
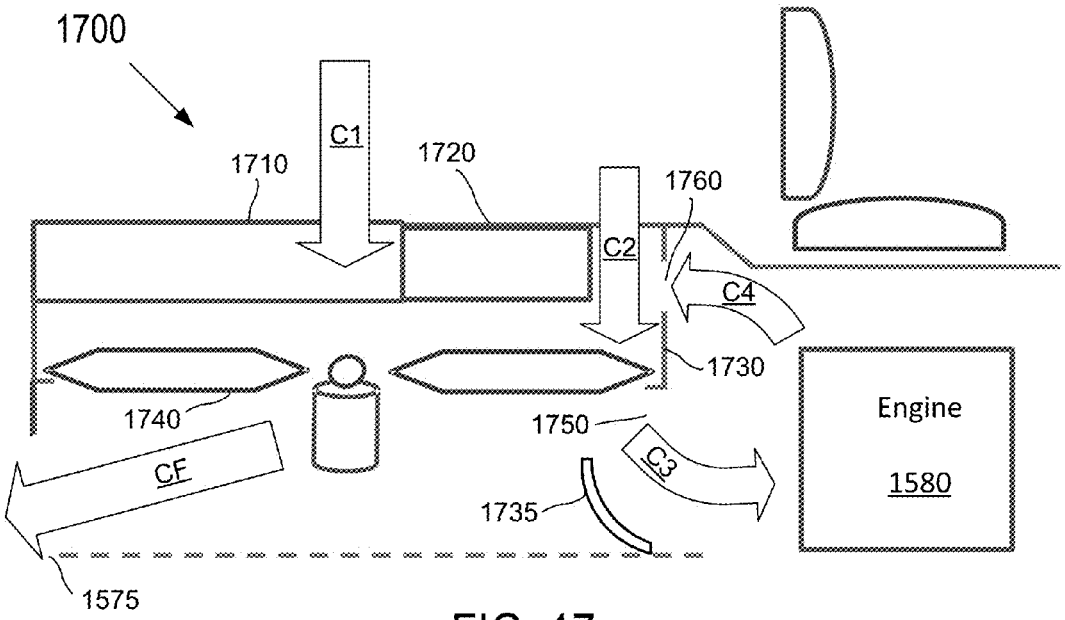
FIG. 17 illustrates yet another example cooling system for providing directional airflow control.

FIG. 17 illustrates yet another example cooling system 1700 for providing directional airflow control. Cooling system 1700 may comprise one or more radiators, such as an engine radiator 1710 and a transmission radiator 1720 placed in a generally horizontal orientation within a containment 1730. A fan 1740 may be configured to draw airflow C1 through engine radiator 1710 and transmission radiator 1720 in a generally vertical direction from outside of the vehicle.

A portion of airflow C1 drawn into cooling system 1700 may be directed out of the exhaust port 1575 as exhaust CF, and another portion of airflow C2 may be drawing into cooling system 1700 and directed into or through the engine compartment 1580 as airflow C3. Airflow C3 may be directed out of an opening 1750 below radiator/fan containment 1730.

A gap 1760 may be provided next to the one or more radiators. Gap 1760 may be configured to provide an additional path for air C4 that comes from within engine compartment 1580 to circulate with, or mix with, a secondary airflow C2 that enters cooling system 1700 from outside of the vehicle. Air C4 from engine compartment 1580 may be relatively warmer than secondary airflow C2 and/or airflow C1.

In some examples, opening 1750 may be formed between containment 1730 and a deflection device 1735. Deflection device 1735 may be stationary, and in some examples may be shaped as a curved surface. In other examples, deflection device 1735 may be non-stationary and configured to vary in shape and/or position to change a direction and/or amount of the airflow C3 entering engine compartment 1580.

In some examples, the one or more radiators may be laterally offset within containment 1730 such that secondary airflow C2 may be drawn from above the vehicle and pass through opening 1750 without passing through the one or more radiators. By offsetting the one or more radiators, cooling system 1700 may be configured to preferentially direct secondary.

Figure 18:
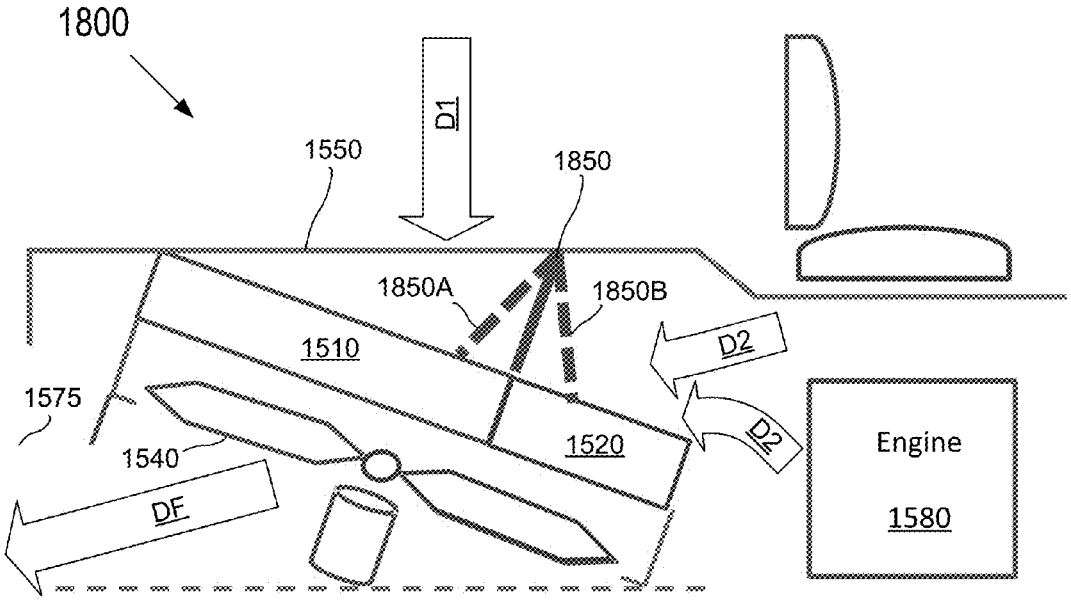
FIG. 18 illustrates an example cooling system comprising the cooling fan of FIG. 15 together with a directional airflow control.

FIG. 18 illustrates an example cooling system 1800 comprising the cooling fan 1540 of FIG. 15, positioned at an inclined angle, together with a directional airflow control 1850. Directional airflow control 1850 may be configured to control an airflow D2 from within or through engine compartment 1580, towards one or both of engine radiator 1510 and transmission radiator 1520. For example, directional airflow control 1850 (shown as a solid line) may be configured to direct airflow D2 through only one of the radiators, such as transmission radiator 1520, in a first mode of operation. In a second mode of operation 1850A, directional airflow control 1850 may be configured to direct airflow D2 towards a second radiator, such as engine radiator 1510. In some examples, a first portion of airflow D2 may be directed to engine radiator 1510 and a second portion of airflow D2 may be directed to transmission radiator 1520.

Directional airflow control 1850 may be configured to preferentially direct a majority of airflow D2 through one of the radiators. In a further mode of operation 1850B, directional airflow control 1850 may be configured to direct airflow D2 towards a particular portion of one of the radiators, such as transmission radiator 1520, or to restrict the amount of airflow D2 which flows through one or more of the radiators. In some examples, directional airflow control 1850 may be configured to mix airflow D2 together with external air D1 which is drawn from above the vehicle 1550 prior to passing the mixed airflow through one or more radiators, such as engine radiator 1510. After passing through the one or more radiators, the mixed airflow may exit the exhaust port 1575 as exhaust DF.

In some examples, directional airflow control 1850 may be mounted above the one or more radiators by a rotating or pinned joint. Additionally, directional airflow control 1850 may be operatively connected to a solenoid. Solenoid may be actuated in response to one or more sensor inputs, such as a radiator temperature, to control a position of directional airflow control 1850 in the one or more modes of operation.

Figure 19:
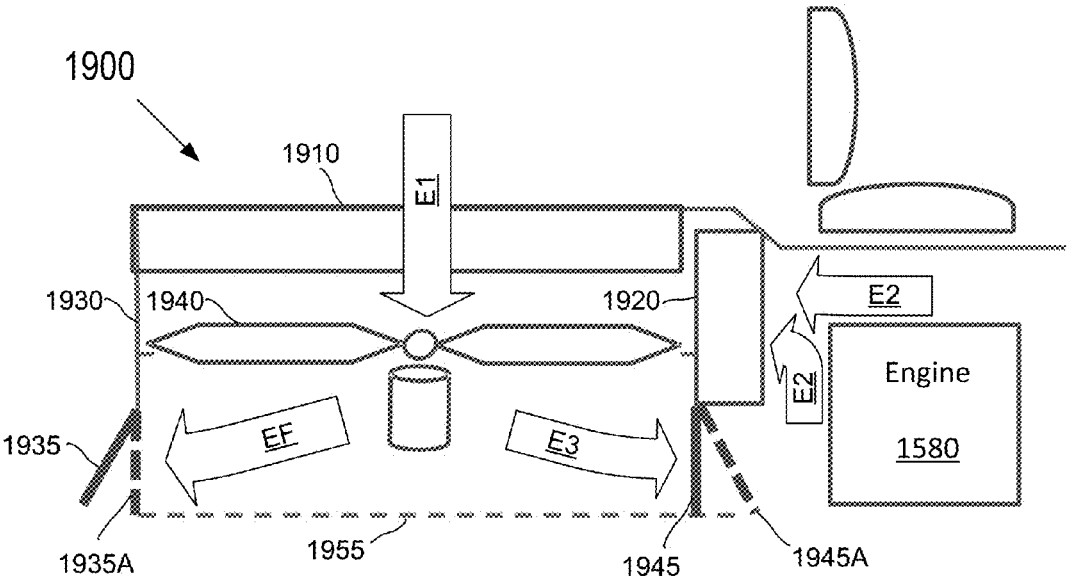
FIG. 19 illustrates an example cooling system with two directional airflow control devices.

FIG. 19 illustrates an example cooling system 1900 with one or more directional airflow control devices, such as a first directional control device 1935 and a second directional control device 1945. A fan 1940 is shown located below a horizontally oriented first radiator 1910. In some examples, first radiator 1910 may comprise an engine radiator. One or both of fan 1940 and first radiator 1910 may extend along substantially the entire length of a containment structure 1930. Positioning an approximate centerline of first radiator 1910 above the centerline of fan 1940 may provide for an even load to the fan motor.

Cooling system 1900 may further comprise a second radiator 1920 located adjacent to containment structure 1930 in a vertically oriented position. Second radiator 1920 may comprise a transmission radiator. In still other examples, second radiator 1920 may be oriented in an angled or tilted position with respect to vertical. Airflow E2 coming from within or through engine compartment 1580 may pass through second radiator 1920 before entering containment structure 1930 and mixing with an external airflow El which is drawn from outside of the vehicle.

In a first mode of operation, first control device 1935 and second control device 1945, shown in solid lines, may be configured to direct the mixed airflow E1, E2 out of the vehicle as exhaust EF. In a first mode of operation, first control device 1935 may be opened and second control device 1945 may be closed. In some examples, first control device 1935 may be configured to be located in a closed position 1935A to restrict or prohibit the flow of exhaust EF.

In a second mode of operation, second control device 1945 may be configured to be located in an opened position 1945A to allow a portion of external airflow El to enter engine compartment 1580 as airflow E3. Airflow E3 may be mixed together with airflow E2 prior to reentering containment structure 1930 in a circular manner. In some examples, the second mode of operation may be associated with operation of cooling system 1900 on very hot days to maintain a relatively low load on the engine and/or fan 1940 and to cool exhaust EF.

The above examples are provided for illustrative purposes only, and other combinations of priority, angle, duration, and/or affected components are contemplated herein. Additionally, whereas various examples describe directing, redirecting, and/or deflecting air or airflow, in some examples, one or more of the systems and/or devices may be configured to additionally operate with water, cleaning agents, solvents, other types of fluids, or any combination thereof.

Having described and illustrated various examples herein, it should be apparent that other examples may be modified in arrangement and detail. We claim all modifications and variations coming within the spirit and scope of the following claims.

The invention claimed is:

1. A cooling system for an industrial vehicle, comprising:

one or more heat radiation devices located in a containment, wherein the one or more heat radiation devices are configured to cool a plurality of components in the industrial vehicle;

an air intake device configured to draw an external airflow from outside of the industrial vehicle into the containment, wherein the external airflow passes through the one or more heat radiation devices, and wherein the air intake device is further configured to draw air from an engine compartment; and a control device operatively connected to the containment, wherein the control device is configured to selectively direct at least a portion of the external airflow to the plurality of components in the industrial vehicle after the external airflow passes through the one or more heat radiation devices, wherein the external airflow is mixed with the air drawn from the engine compartment, and wherein the control device is configured to:

in a first operation, direct the mixed airflow out of the containment as exhaust, wherein the external airflow is prohibited from entering the engine compartment; and in a second operation, direct a portion of the external airflow into the engine compartment.

2. The cooling system of claim 1, further comprising an exhaust port located on an opposite side of the containment as the control device, wherein the external airflow that is not directed to the plurality of components exits the industrial vehicle out of the exhaust port.

3. The cooling system of claim 2, wherein the one or more heat radiation devices are configured to circulate a liquid coolant through at least one of the plurality of components located in the engine compartment, and wherein the control device is configured to selectively direct a majority of the portion of the external airflow into the engine compartment.

4. The cooling system of claim 1, wherein the air intake device comprises a fan located in a generally horizontal orientation within the containment, and wherein the fan is configured to draw air from above the industrial vehicle in a generally vertical direction.

5. The cooling system of claim 4, wherein the fan is located below the one or more heat radiation devices, wherein the one or more heat radiation devices are located in a generally horizontal orientation above the containment, and wherein the external airflow passes in the generally vertical direction through the one or more heat radiation devices.

6. The cooling system of claim 5, wherein the containment is configured to redirect the external airflow in a generally lateral direction after passing through the one or more heat radiation devices, wherein a first portion of the external airflow is redirected out of the industrial vehicle via an exhaust port, and wherein a second portion of the external airflow is redirected to the plurality of components via the control device.

7. The cooling system of claim 1, wherein the one or more heat radiating devices comprise a radiator horizontally oriented above the air intake device, wherein the air intake device comprises a fan having a diameter that is larger than the radiator, and wherein one or more gaps formed about the diameter of the radiator provide an additional path for a secondary airflow to enter the containment without passing through the radiator.

8. The cooling system of claim 1, wherein the one or more heat radiating devices comprise a first radiator horizontally oriented above the air intake device and a second radiator vertically oriented adjacent the air intake device, and wherein the air that is drawn from the engine compartment passes through the second radiator before being mixed with the external airflow that passes through the first radiator.

9. A cooling apparatus for an industrial vehicle, comprising:

means for radiating heat generated by a plurality of components in the industrial vehicle, wherein the means for radiating is located in a containment;

means for drawing an external airflow from outside of the industrial vehicle into the containment, wherein the external airflow passes through the means for radiating heat, and wherein the means for drawing is further configured to draw air from an engine compartment; and means for selectively directing at least a portion of the external airflow to the plurality of components in the industrial vehicle after the external airflow passes through the means for radiating heat, wherein the external airflow is mixed with the air drawn from the engine compartment, and wherein the means for directing airflow is configured to:

in a first operation, direct the mixed airflow out of the containment as exhaust, wherein the external airflow is prohibited from entering the engine compartment; and in a second operation, direct a portion of the external airflow into the engine compartment.

10. The cooling apparatus of claim 9, wherein the means for cooling comprises means for circulating a liquid coolant through at least one of the plurality of components located in the engine compartment, and wherein the means for selectively directing airflow comprises means for directing the portion of the external airflow into the engine compartment.

11. The cooling apparatus of claim 10, wherein the means for selectively directing airflow comprises:

means for directing a first portion of the external airflow towards an engine head during a first mode of operation; and means for directing a second portion of the external airflow towards an engine block during a second mode of operation.

12. The cooling apparatus of claim 11, wherein the first portion of the external airflow continues to be directed towards the engine head during the second mode of operation, and wherein an overall amount of the external airflow directed into the engine compartment during the second mode of operation is greater than the first portion of the external airflow directed into the engine compartment during the first mode of operation.

13. The cooling apparatus of claim 11, wherein the means for selectively directing airflow further comprises means for directing a third portion of the external airflow towards a transmission system during a third mode of operation.

14. The cooling apparatus of claim 13, wherein during the third mode of operation the first portion of the external airflow continues to be directed towards the engine head and the second portion of the external airflow continues to be directed towards the engine block.

15. The cooling apparatus of claim 9, wherein the means for selectively directing airflow comprises means for varying an amount of the portion of the external airflow that is directed to each of the plurality of components in the industrial vehicle.

16. The cooling apparatus of claim 9, further comprising an exhaust port located on an opposite side of the containment as the means for directing, wherein the means for selectively directing airflow comprises means for partially sealing the containment, and wherein substantially all of the external airflow that enters the partially sealed containment exits out of the exhaust port.

17. A method of cooling an industrial vehicle, comprising:

radiating, by one or more radiating devices, heat generated by a plurality of components in the industrial vehicle, wherein the one or more radiating devices are located in a containment;

drawing an external airflow from outside of the industrial vehicle into the containment, wherein the external airflow passes through the one or more radiating devices;

drawing air from an engine compartment; and selectively directing, by a control device, at least a portion of the external airflow to the plurality of components in the industrial vehicle after the external airflow passes through the one or more radiating devices, wherein the external airflow is mixed with the air drawn from the engine compartment, and wherein selectively directing the external airflow comprises:

in a first operation, directing the mixed airflow out of the containment as exhaust, wherein the external airflow is prohibited from entering the engine compartment; and in a second operation, directing a portion of the external airflow into the engine compartment.

18. The method of claim 17, further comprising opening the control device prior to selectively directing the portion of the external airflow, wherein the control device is closed during vehicle start-up, and wherein substantially all of the external airflow that enters the containment exits out of an exhaust port of the industrial vehicle when the control device is closed.

19. The method of claim 18, wherein opening the control device comprises opening the control device to a first position, and wherein selectively directing the portion of the external airflow comprises directing a first portion of the external airflow to an engine head with the control device opened to the first position.

20. The method of claim 19, further comprising:

opening the control device to a second position; and directing a second portion of the external airflow to an engine block, wherein the first portion of the external airflow continues to be directed to the engine head with the control device opened to the second position.

21. The method of claim 20, further comprising:

opening the control device to a third position; and directing a third portion of the external airflow to a transmission system, wherein both the first portion of the external airflow continues to be directed to the engine head and the second portion of the external airflow continues to be directed to the engine block with the control device opened to the third position.

22. The method of claim 21, further comprising receiving input regarding a temperature associated with one or more of the plurality of components, wherein the control device is selectively opened to either the first position, the second position, or the third position in response to receiving the input.

23. The method of claim 17, wherein the first operation comprises an engine startup that is performed when a temperature of the engine is below a threshold operating temperature, and wherein the second operation comprises a vehicle operating condition when the temperature of the engine is above the threshold operating temperature.

24. The method of claim 17, wherein the air intake device comprises a fan oriented at an angle within the containment, and wherein the method further comprises varying the angle of the fan to selectively direct the external airflow to the plurality of components.

* * * * *